US011519341B2

(12) United States Patent
Kiku

(10) Patent No.: US 11,519,341 B2
(45) Date of Patent: Dec. 6, 2022

(54) INTAKE DEVICE FOR MULTIPLE-CYLINDER ENGINE AND FUEL DELIVERY PIPE FOR INTAKE DEVICE

(71) Applicant: MIKUNI CORPORATION, Tokyo (JP)

(72) Inventor: Yuta Kiku, Odawara (JP)

(73) Assignee: MIKUNI CORPORATION, Tokyo (JP)

( * ) Notice: Subject to any disclaimer, the term of this patent is extended or adjusted under 35 U.S.C. 154(b) by 0 days.

(21) Appl. No.: 17/690,586

(22) Filed: Mar. 9, 2022

(65) Prior Publication Data

US 2022/0290621 A1 Sep. 15, 2022

(30) Foreign Application Priority Data

Mar. 11, 2021 (JP) ..... JP2021-039070

(51) Int. Cl.
*F02M 37/00* (2006.01)
*F02D 9/10* (2006.01)
*F02M 35/10* (2006.01)

(52) U.S. Cl.
CPC ..... *F02D 9/10* (2013.01); *F02M 35/10216* (2013.01); *F02M 37/0047* (2013.01)

(58) Field of Classification Search
CPC ... F02M 37/0047; F02M 35/1021; F02D 9/10
USPC ..... 123/336, 337, 468, 469, 470
See application file for complete search history.

(56) References Cited

U.S. PATENT DOCUMENTS 9,150,269 B2 10/2015 Ozaki et al.
2005/0166884 A1 8/2005 Lee et al.

FOREIGN PATENT DOCUMENTS

JP 2012-92819 5/2012

OTHER PUBLICATIONS

Extended European Search Report, dated Jul. 26, 2022, in corresponding European Patent Application No. 22160783.1 (9 pp.).

*Primary Examiner* — Hai H Huynh

(57) ABSTRACT

The present invention provides an intake device and a fuel delivery pipe for a multiple-cylinder engine including a transpiration gas passage or an intake air pressure collecting passage capable of reducing the number of components and improving assembly operability. The intake device and the fuel delivery pipe for a multiple-cylinder engine include: a throttle body including a plurality of bores, each of which communicates with an inside of each cylinder of the engine, and provided with throttle valves for adjusting intake volumes inside the bores in an openable and closable manner; injectors provided in the throttle body and injecting a fuel to the bores; a delivery pipe for supplying the fuel to the injectors; and an intake pipe communication passage connected to an inside of the bores and communicating with the inside of the bores, and the intake pipe communication passage is formed integrally with the delivery pipe.

13 Claims, 15 Drawing Sheets

INTAKE DEVICE FOR MULTIPLE-CYLINDER ENGINE AND FUEL DELIVERY PIPE FOR INTAKE DEVICE

CROSS REFERENCE TO RELATED APPLICATIONS

This application claims the priority benefit of Japanese Patent Application No. 2021-039070, file on Mar. 11, 2021, the contents of which are incorporated herein by reference.

BACKGROUND OF THE INVENTION

Field of the Invention

The present invention relates to an intake device and a fuel delivery pipe for a multiple-cylinder engine.

Description of the Related Art

An intake device for an engine of this type includes a throttle body in which throttle valves for adjusting intake volumes are provided in bores, which communicate with the inside of cylinders of the engine, to be able to be opened and closed, injectors that inject a fuel into the bores, a fuel passage for supplying the fuel from a fuel tank to the injectors, a transpiration gas passage for supplying transpiration gas adsorbed by a canister of a transpiration gas treatment device to the inside of the bores, and the like. In a case of a multiple-cylinder engine including a plurality of cylinders, the throttle body is provided with the bores and the injectors such that the numbers correspond to the number of cylinders, and the fuel from the fuel tank is branched by a delivery pipe inside which branched fuel passages are formed and is then supplied to each injector. In regard to the transpiration gas from the canister, a plurality of rubber hoses are combined to configure the transpiration gas passage into a branched shape as in an intake device described in Patent Document 1, for example, and the transpiration gas is branched in the process of distribution therein and is then supplied to the inside of each bore.

A transpiration gas passage described in Patent Document 1 will be described in further detail. The transpiration gas passage includes a plurality of three-way nipples, rubber hoses, and stopper clips. In a case of a four-cylinder engine, for example, the three-way nipple is connected to the rubber hose from the canister to branch the passage into two directions, the three-way nipple is connected to each branch end via a rubber hose to branch each branch into two directions, and one end of a rubber hose is connected to each of the total of four branch ends. In this manner, the transpiration gas passage is formed, the other ends of the total of four rubber hoses are connected to transpiration gas receiving ports provided at the bores in the throttle body, and the clips are attached to connection locations of the rubber hoses, the three-way nipples, and the transpiration gas receiving ports.

Therefore, the transpiration gas from the canister is branched into two directions by the three-way nipple on the upstream side, is then branched into two directions by each of the three-way nipples on the downstream side, is then supplied to the inside of each bore through each transpiration gas receiving port, and is then burned and treated along with air-fuel mixture inside the cylinders of the engine during operation of the engine.

PRIOR ART DOCUMENT

Patent Document

Patent Document 1: Japanese Patent Laid-Open No. 2012-92819

SUMMARY OF THE INVENTION

Problems to be Solved by the Invention

However, the transpiration gas passage for the intake device described in Patent Document 1 includes a large number of components, requires complicated arrangement of the transpiration gas passage, and requires time and effort for assembly, which leads to an increase in assembly cost and component cost and thus an increase in manufacturing cost.

In order to construct the transpiration gas passage of the aforementioned four-cylinder engine, for example, it is necessary to prepare a large number of components including three three-way nipples, six rubber hoses, and twelve clips. Moreover, a plurality of types of rubber hoses with different lengths and shapes are used, and stock management of the rubber hoses is thus complicated. Also, the transpiration gas including the fuel has a characteristic of penetrating through compositions of the rubber hoses, and it is thus necessary to use expensive rubber hoses in which fluorine resin layers that blocks the transpiration gas, for example, are formed on inner surfaces thereof in order to prevent leakage to the outside. All the aforementioned factors lead to a significant increase in manufacturing cost.

Also, an operation of assembling the transpiration gas passage including the large number of components with the throttle body is complicated, and in regard to an operation of attaching the clips that cannot easily be handled to the rubber hoses, in particular, the clips are secured through manual operations of an operator, which imposes a more significant burden on the operator as the number of locations where the clips are attached increases. In a case in which an intake pipe pressure is used as one of pieces of information for engine control, it is necessary to attach an intake air pressure collecting passage made of a rubber hose that is similar to the transpiration gas passage and having a branched shape to the throttle body, to merge the intake air pressures generated in the bores, and to guide the merged intake air pressures to a pressure sensor using the intake air pressure collecting passage, and there is no other way than similarly performing a complicated operation to form the intake air pressure collecting passage as well.

As described above, since the assembling of the intake air pressure collecting passage and the transpiration gas passage using the rubber hoses accompanies complicated operations, a burden on the operator is large, there may be a disadvantage that assembling properties are degraded, and there is room for improvement in terms of assembly operability.

The present invention was made to solve such problems, and an object thereof is to provide an intake device and a fuel delivery pipe for a multiple-cylinder engine including a transpiration gas passage or an intake air pressure collecting passage capable of reducing the number of components and improving assembly operability.

Means for Solving the Problems

In order to achieve the aforementioned object, an intake device for a multiple-cylinder engine according to the present invention includes: a throttle body including a plurality of bores, each of which communicates with an inside of each cylinder of the engine, and provided with throttle valves for adjusting intake volumes inside the bores in an openable and closable manner; injectors provided in the throttle body and injecting a fuel to each bore; a delivery pipe for supplying the fuel to the injectors; and an intake pipe communication passage connected to the inside of each bore and communicating with the inside of each bore, and the intake pipe communication passage is formed integrally with the delivery pipe (Claim 1).

As another aspect, the delivery pipe may be provided with a fuel inlet port connected to a fuel tank side and fuel outlet ports connected to the injectors in the throttle body, a fuel passage branched from the fuel inlet port and extending to each fuel outlet port being formed inside the delivery pipe, and the intake pipe communication passage may be formed therein to be parallel to an alignment direction of each cylinder with the fuel passage (Claim 2).

As another aspect, the delivery pipe may be provided with a collecting connection port for connection to the intake pipe communication passage and may be provided with a delivery pipe-side connection port for connection to an inside of each bore (Claim 3).

As another aspect, the throttle body may include each throttle body-side connection port for connection to the delivery pipe-side connection port, the throttle body-side connection port may be a transpiration gas receiving port for supplying, to the inside of each bore, transpiration gas adsorbed by a canister of a transpiration gas treatment device, the collecting connection port of the delivery pipe may be a transpiration gas inlet port to which the canister of the transpiration gas treatment device is connected, and the intake pipe communication passage of the delivery pipe may be a transpiration gas passage branching the transpiration gas from the canister flowing in from the transpiration gas inlet port and guiding the transpiration gas to each transpiration gas receiving port of the throttle body through each delivery pipe-side connection port (Claim 4).

As another aspect, the throttle body may include each throttle body-side connection port for connection to the delivery pipe-side connection port, and the throttle body-side connection port may be an intake air pressure extraction port for extracting an intake air pressure generated inside each bore, the collecting connection port of the delivery pipe may be a sensor connection port to which a pressure sensor detecting the intake air pressure is connected, and the intake pipe communication passage of the delivery pipe may be an intake air pressure collecting passage merging intake air pressures generated in each bore of the throttle body and guided from the intake air pressure extraction port to the delivery pipe-side connection port and guiding the merged intake air pressures to the collecting connection port (Claim 5).

As another aspect, each of the fuel passage and the intake pipe communication passage may be opened from one end surface of the delivery pipe toward one side, and the fuel inlet port and the collecting connection port may be produced as components separated from the delivery pipe and may be connected to opening locations of the fuel passage and the intake pipe communication passage from the other side (Claim 6).

As another aspect, the delivery pipe may be split into a first delivery pipe and a second delivery pipe, the first delivery pipe and the second delivery pipe may have the fuel passages opened to face each other and may have the intake pipe communication passages opened to face each other, and the fuel inlet port and the collecting connection port may be produced as components separated from the first delivery pipe and the second delivery pipe, each of the fuel inlet port and the collecting connection port being sandwiched between the first delivery pipe and the second delivery pipe and being connected to opening locations of the fuel passages and the intake pipe communication passages from both sides (Claim 7).

As another aspect, the fuel inlet port and the collecting connection port may be produced as components separated from each other and may have angles which are changeable around axial lines of cylindrical portions formed on both sides of the fuel inlet port and the collecting connection port (Claim 8).

As another aspect, the fuel inlet port and the collecting connection port may be produced as a mutually integrated component (Claims 9, 10).

As another aspect, each delivery pipe-side connection port of the delivery pipe may be connected to each throttle-side connection port of the throttle body via a connection pipe produced as a separated component (Claim 11).

Also, a fuel delivery pipe according to the present invention is used for an engine including a throttle body having a plurality of bores, each of which communicates with an inside of each cylinder of the engine, and is provided with throttle valves for adjusting intake volumes inside the bores in an openable and closable manner and injectors provided in the throttle body and injecting a fuel to each bore, the fuel delivery pipe includes: a fuel inlet port connected to a fuel tank side; fuel outlet ports connected to the injectors of the throttle body; a fuel passage formed in the fuel delivery pipe, branched from the fuel inlet port, and extending to the fuel outlet ports; an intake pipe communication passage supplying transpiration gas to each bore; a collecting connection port for introducing the transpiration gas into the intake pipe communication passage; and a delivery pipe-side connection port for supplying the transpiration gas to the inside of each bore, and both the fuel passage and the intake pipe communication passage extend to be parallel to an alignment direction of each cylinder and are integrally formed (Claim 12).

Also, a fuel delivery pipe according to the present invention is used for an engine including a throttle body having a plurality of bores, each of which communicates with an inside of each cylinder of the engine, and is provided with throttle valves for adjusting intake volumes inside the bores in an openable and closable manner and injectors provided in the throttle body and injecting a fuel to each bore, the fuel delivery pipe includes: a fuel inlet port connected to a fuel tank side; fuel outlet ports connected to the injectors of the throttle body; a fuel passage formed inside the fuel delivery pipe, branched from the fuel inlet port, and extending to the fuel outlet ports; an intake pipe communication passage for introducing an intake air pressure of each bore; a collecting connection port for connection to a pressure sensor for measuring a pressure in the intake pipe communication passage; and a delivery pipe-side connection port for connection to the inside of each bore, and both the fuel passage and the intake pipe communication passage extend to be parallel to an alignment direction of each cylinder and are integrally formed (Claim 13).

Advantageous Effects of the Invention

According to the present invention, it is possible to provide an intake device for a multiple-cylinder engine and a fuel delivery pipe used for an engine intake device capable of reducing manufacturing cost and realizing satisfactory assembly operability.

DETAILED DESCRIPTION OF THE INVENTION

Figure 1:
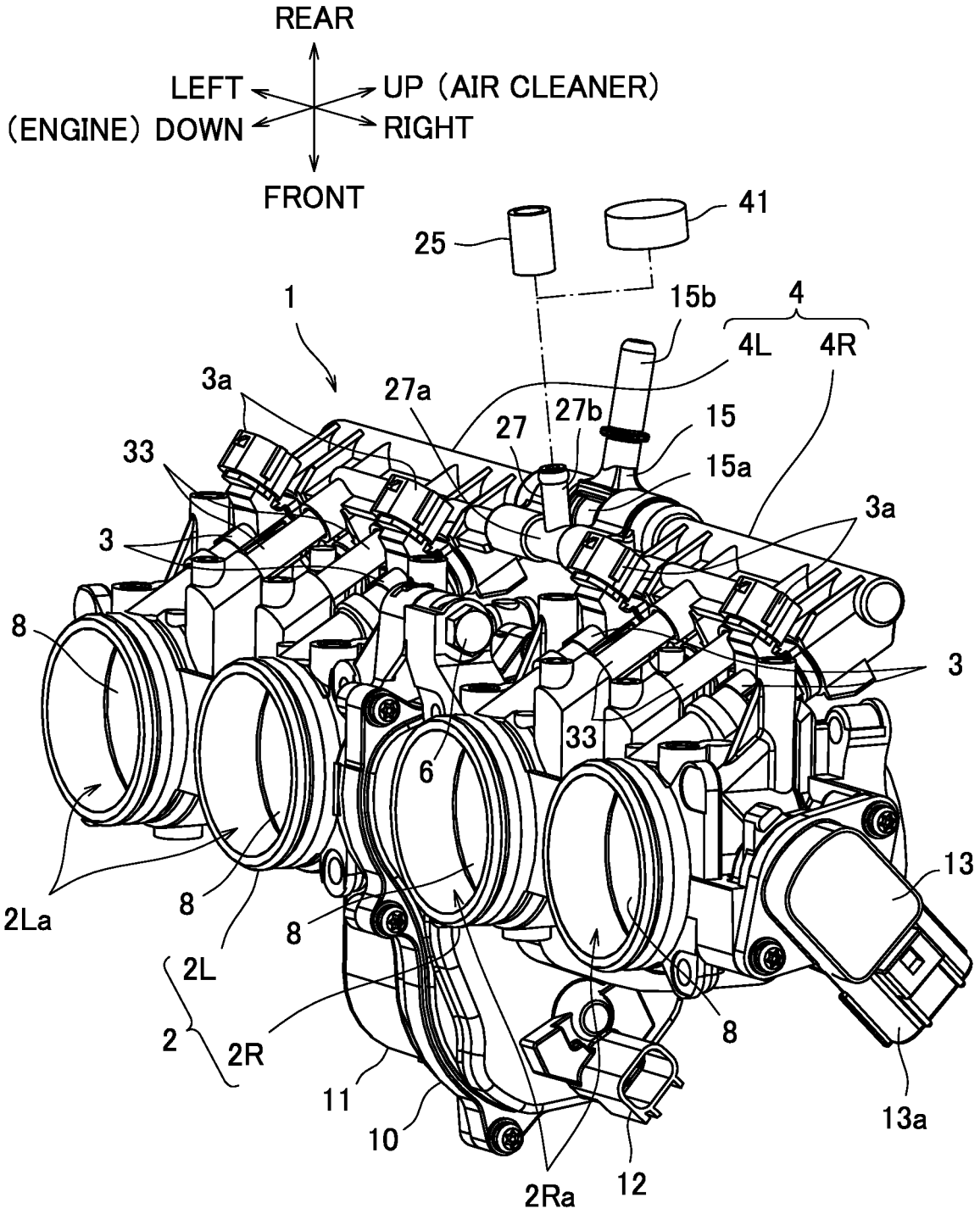
FIG. 1 is a perspective view illustrating an intake device for a multiple-cylinder engine according to an embodiment.
Figure 2:
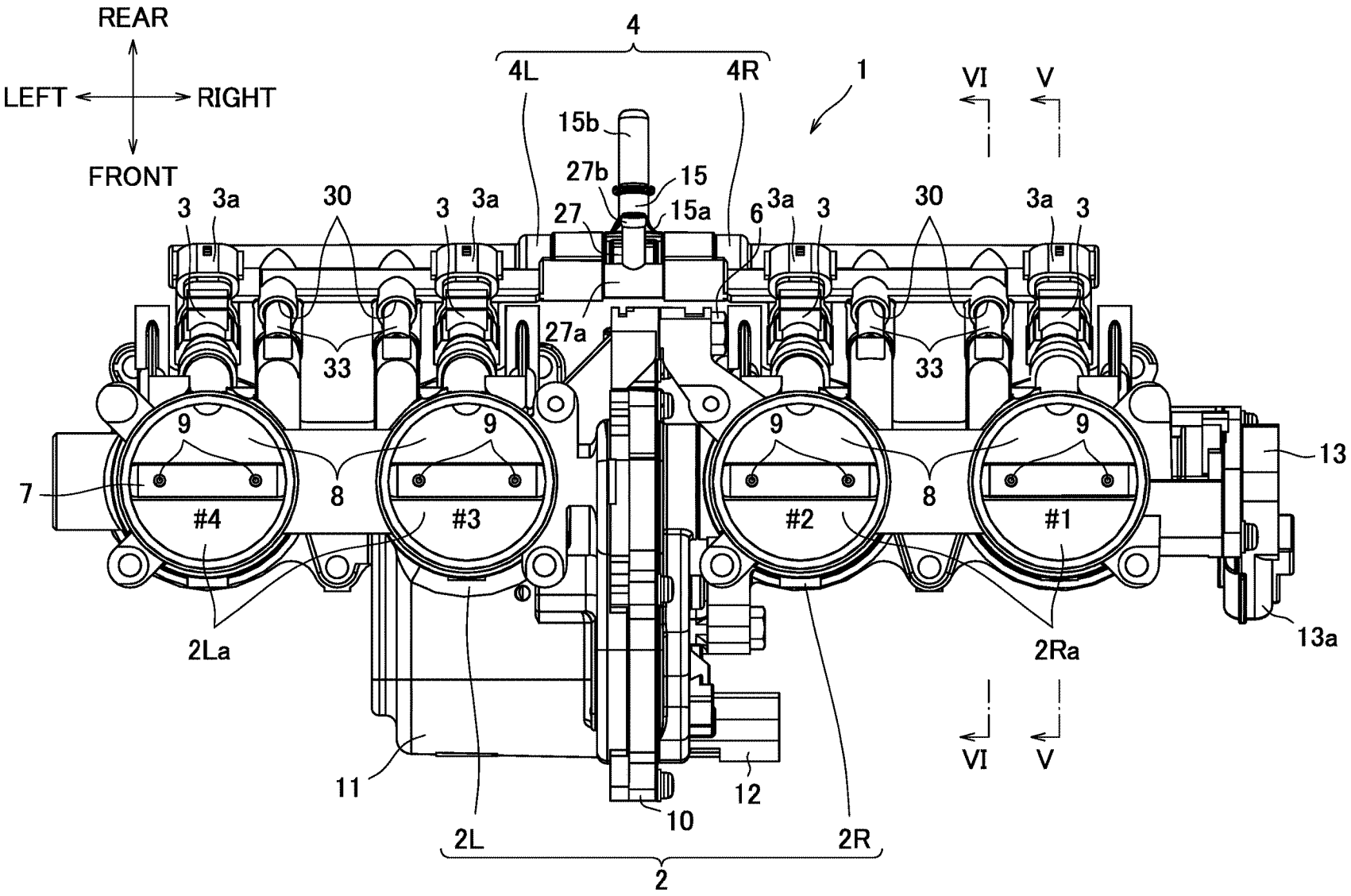
FIG. 2 is a bottom view of the intake device for a multiple-cylinder engine when seen from the lower side.
Figure 3:
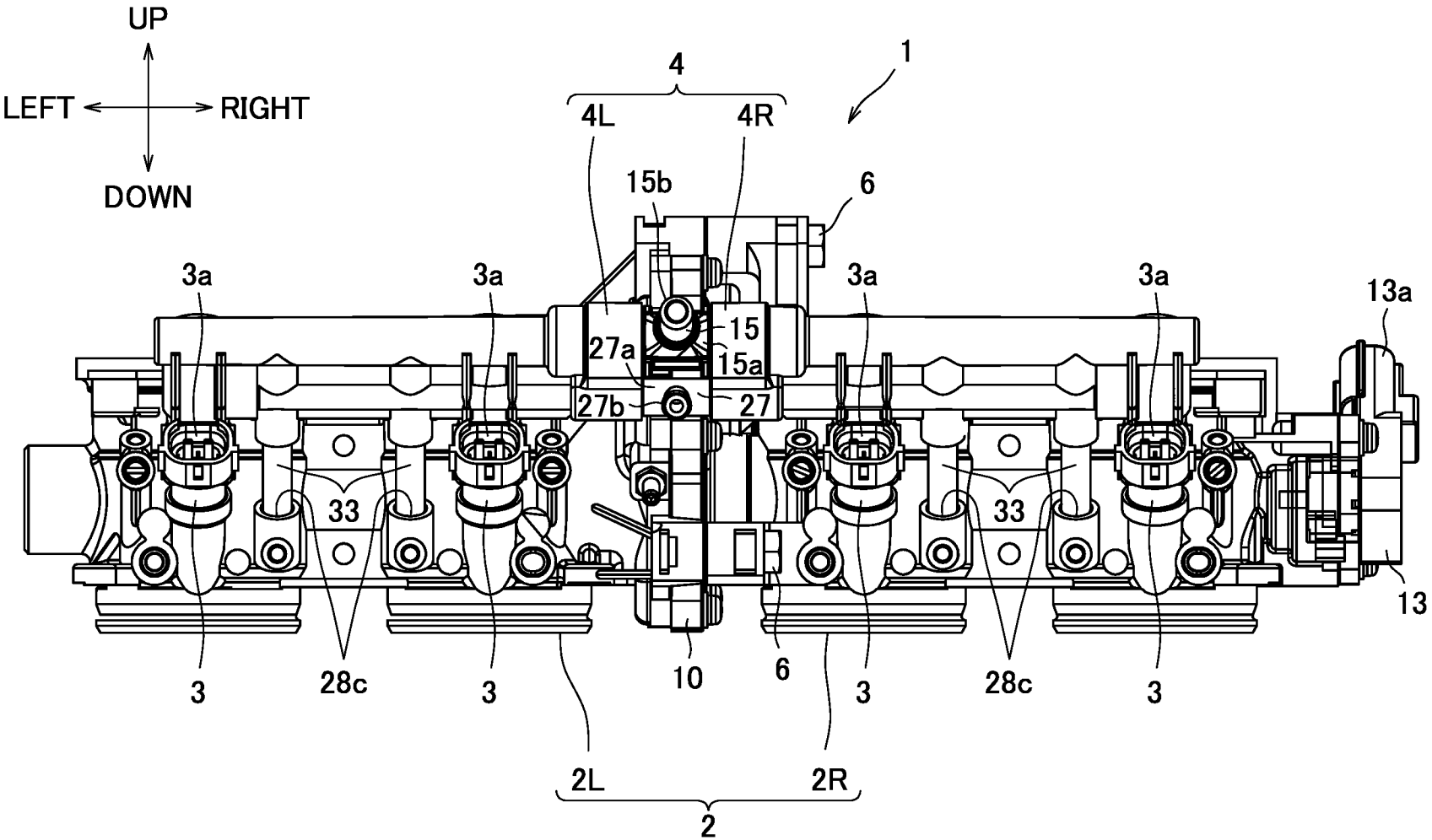
FIG. 3 is a rear view of the intake device for a multiple-cylinder engine when seen from the rear side.
Figure 4:
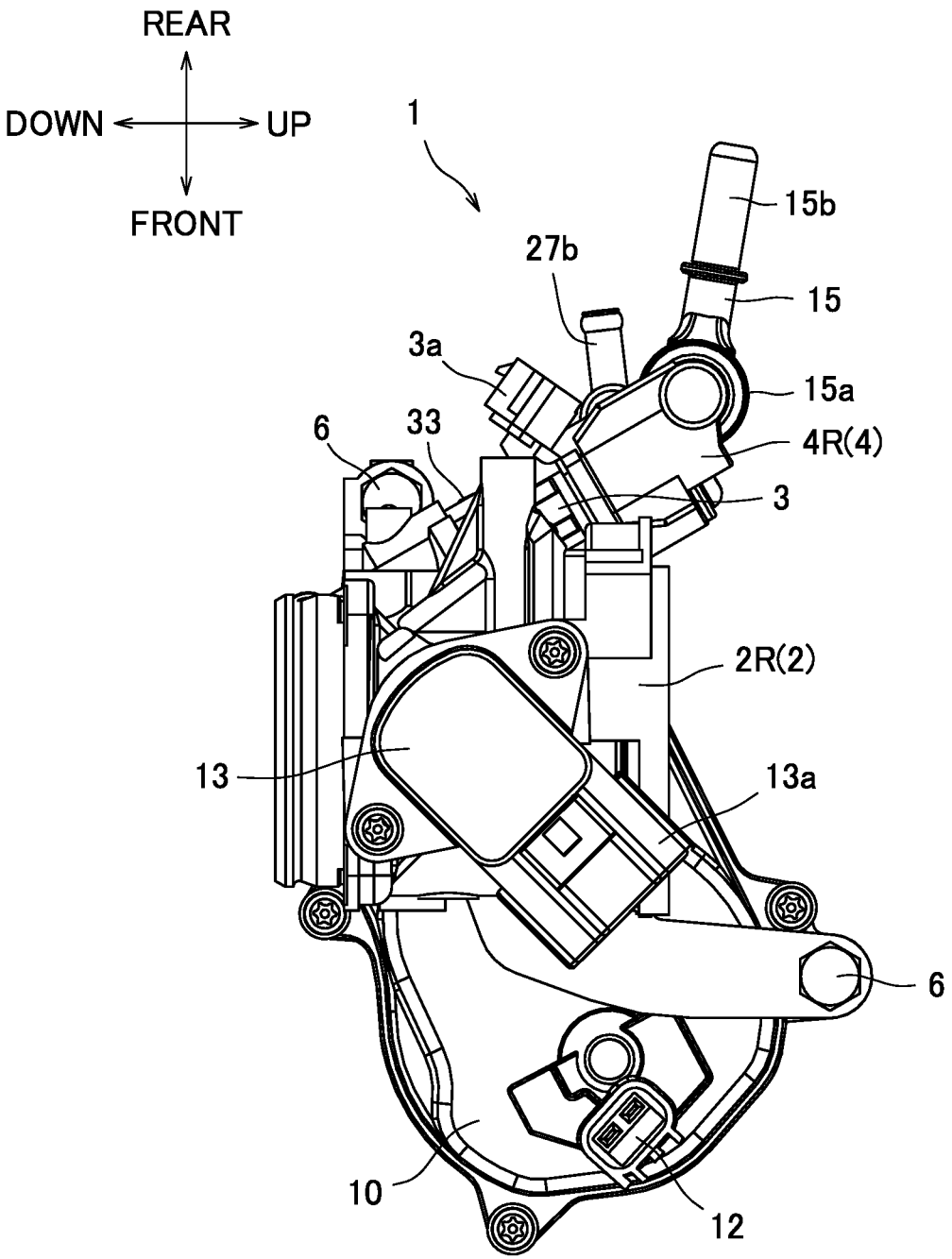
FIG. 4 is a side view of the intake device for a multiple-cylinder engine when seen from the right side.

Hereinafter, an embodiment in which the present invention is implemented as an intake device for an in-line four-cylinder engine mounted in a motorcycle will be described.

An engine that is a traveling power source is mounted in a vehicle body of the motorcycle, which is not illustrated, and a downdraft-type throttle body 2 constituting an intake device 1 is attached to the engine on the upper side. In the following description, front-rear, left-right, and up-down directions will be defined with reference to a driver who is riding the motorcycle. Therefore, in FIG. 1 for example, the engine is located below the throttle body 2, and an air cleaner for filtering intake air is located above the throttle body 2.

As illustrated in FIGS. 1 to 4, 9, and the like, the intake device 1 is configured with: a throttle body 2 in which bores 2La and 2Ra communicating with the inside of each cylinder in a state where the intake device 1 is attached to the engine are formed and throttle valves 8 for adjusting intake volumes are provided in the bores 2La and 2Ra in an openable and closable manner; injectors 3 injecting a fuel to the inside of the bores 2La and 2Ra; a delivery pipe 4 branching the fuel from a fuel tank into each cylinder and supplying the fuel to each injector 3; a transpiration gas passage 5 branching and guiding transpiration gas adsorbed by a canister of a transpiration gas treatment device, which is not illustrated, to the inside of the bores 2La and 2Ra; and the like.

First, a configuration of the throttle body 2 will be described. The throttle body 2 is configured with a left-side throttle body 2L and a right-side throttle body 2R coupled with a bolt 6. A pair of left and right bores 2Ra corresponding to a cylinder #1 and a cylinder #2 of the engine are formed to penetrate in the up-down direction in the right-side throttle body 2R, and a pair of left and right bores 2La corresponding to a cylinder #3 and a cylinder #4 of the engine are formed to penetrate in the up-down direction in the left-side throttle body 2L. Lower ends of the bores 2La and 2Ra are connected to the engine and communicate with the inside of the corresponding cylinders, and upper ends thereof communicate with the inside of the air cleaner. In the following description, each of the members such as the bores 2La and 2Ra may be represented with the signs #1 to #4 to indicate which of the cylinders the member corresponds to.

One throttle shaft 7 penetrating through the bores 2La and 2Ra in the left-right direction is disposed in the left-side and right-side throttle bodies 2L and 2R and is axially supported by a bearing, which is not illustrated, such that the throttle shaft 7 is able to turn. Disc-shaped throttle valves 8 are secured to the throttle shaft 7 with screws 9 inside the bores 2La and 2Ra, and each throttle valve 8 is opened and closed in accordance with turning of the throttle shaft 7. A gear case 10 is provided between the left-side and right-side throttle bodies 2L and 2R, one side of the gear case 10 expands forward with a motor 11 secured to a left side surface thereof and with a connector 12 provided on a right side surface thereof.

Although not illustrated, an output shaft of the motor 11 and the throttle shaft 7 are coupled via a gear train accommodated inside the gear case 10, and a drive force of the motor 11 is transmitted from the output shaft to the throttle shaft 7 while decelerated through the gear train. The throttle valves 8 are opened and closed in accordance with turning of the throttle shaft 7, and the intake volumes of air distributed through the inside of the bores 2La and 2Ra are adjusted. An opening degree of the throttle at this time is detected by a throttle sensor 13 secured to a right end of the right-side throttle body 2R.

In a mounted state in a vehicle body of the motorcycle, a harness from a control device, which is not illustrated, on the vehicle body side is connected to the connector 12 of the gear case 10 and a connector 13*a* of the throttle sensor 13. Information on the opening degree of the throttle detected by the throttle sensor 13 is output to the control device via the harness and the connector 13*a*, and power is supplied from the control device to the motor 11 via the harness and the connector 12 to thereby adjust the intake volumes as described above. Note that a mechanical configuration in the related art in which a throttle operation of the driver is transmitted to the throttle valves 8 via a wire may be employed instead of such a motor-driven throttle valves 8.

On the other hand, the injectors 3 are disposed to correspond to the bores 2La and 2Ra in the throttle body 2 as illustrated in FIGS. 2, 3, 5, and 7. Specifically, holding holes 14 extending on an obliquely lower front side are provided to penetrate at rear positions of the bores 2La and 2Ra in the throttle body 2, and the injectors 3 are inserted into and secured to the holding holes 14. Distal ends of the injectors 3 project to the inside of the bores 2La and 2Ra on the downstream side of an intake air flowing direction beyond the throttle valves 8, and a pressurized fuel is supplied from a common delivery pipe 4 connected to proximal ends of the injectors 3 as will be described later in detail.

A connector 3*a* provided on one side of each injector 3 is connected to the control device on the vehicle body side via the harness although not illustrated, and each injector 3 is driven to be opened and closed in accordance with a drive signal from the control device. In this manner, the fuel is injected from the injectors 3 to the intake air distributed inside the bores 2La and 2Ra, is supplied as air-fuel mixture to the inside of each cylinder of the engine, and generates an engine torque through combustion.

Figure 5:
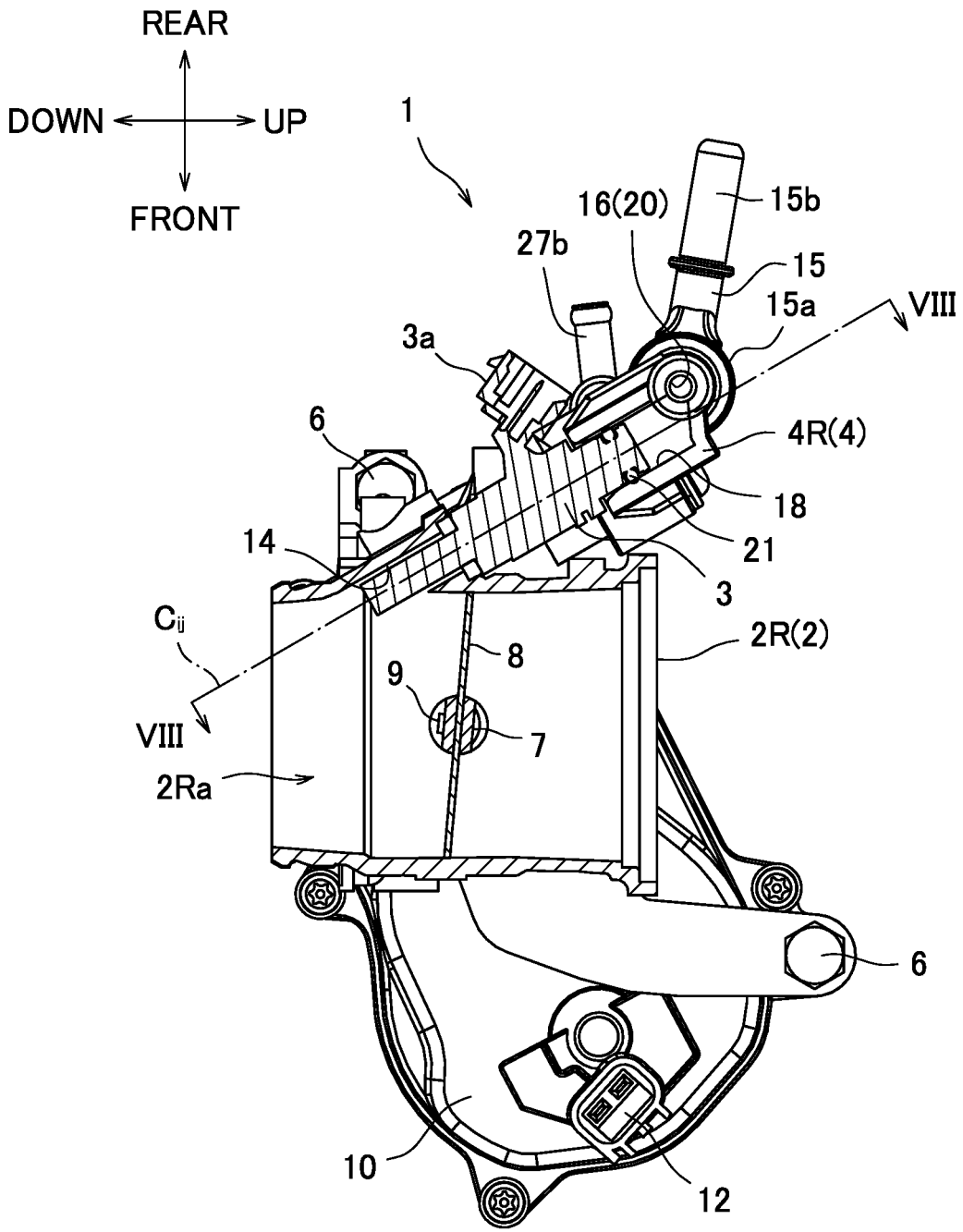
FIG. 5 is a sectional view illustrating a state in which an injector and a delivery pipe are attached to a throttle body and taken along the line V-V in FIG. 2.
Figure 8:
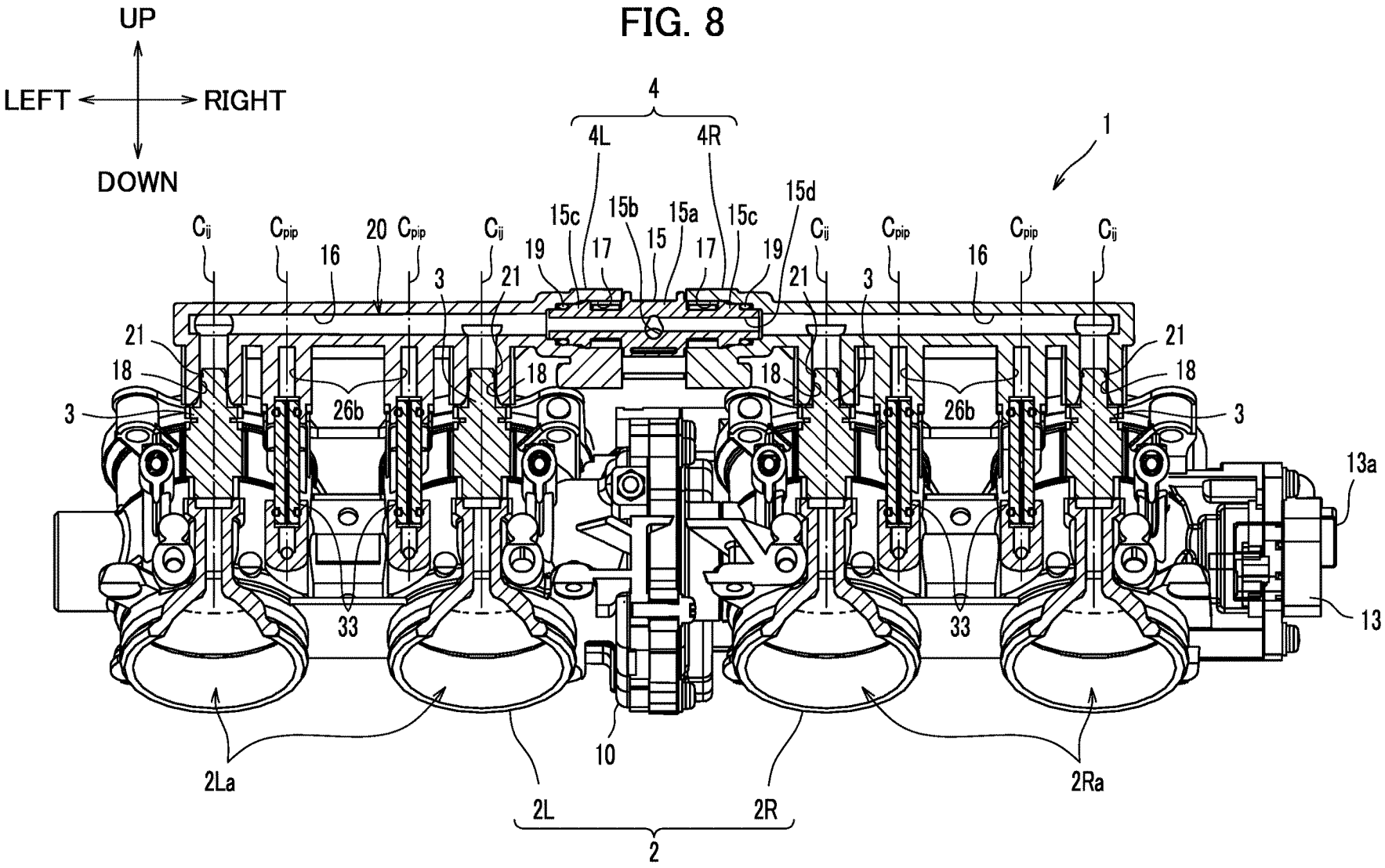
FIG. 8 is a sectional view illustrating a state in which a fuel passage of the delivery pipe and each injector communicate with each other and taken along the line VIII-VIII in FIG. 5.
Figure 11:
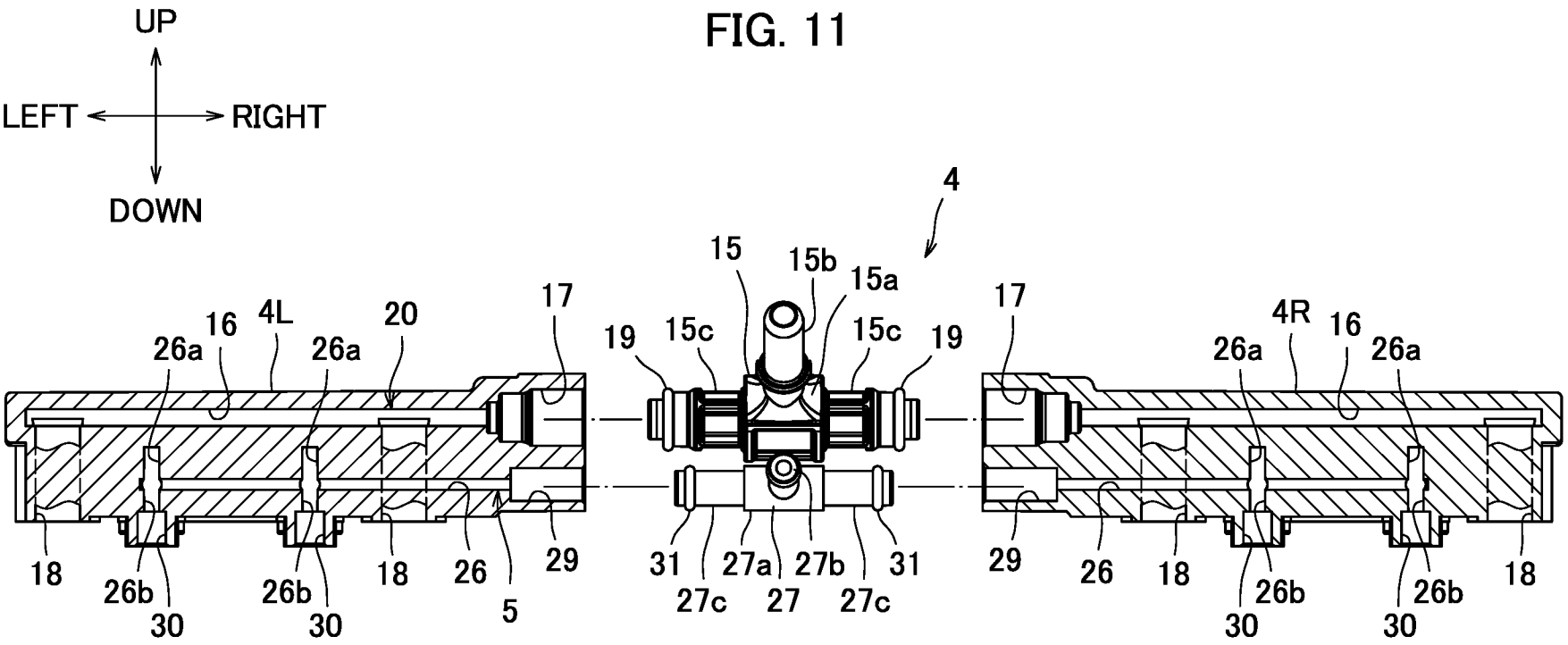
FIG. 11 is an exploded view illustrating a state in which a first delivery pipe and a second delivery pipe have been detached from a fuel inlet port and a transpiration gas inlet port.

As illustrated in FIGS. 5, 8, and 11, the delivery pipe 4 includes a left-side delivery pipe 4L corresponding to the first delivery pipe according to the present invention, a right-side delivery pipe 4R corresponding to the second delivery pipe according to the present invention, and a fuel inlet port 15 sandwiched between both the delivery pipes 4L and 4R. Since the left-side delivery pipe 4L and the right-side delivery pipe 4R have horizontally symmetrical shapes, the right-side delivery pipe 4R will be described as a representative.

The right-side delivery pipe 4R has a rod shape extending in the left-right direction at an upper position of the right-side throttle body 2R, and a right-side fuel passage 16 is formed therein in the longitudinal direction. An upstream insertion hole 17 with a circular section is communicably formed at the left end of the right-side fuel passage 16 and is opened leftward from the left end surface of the right-side delivery pipe 4R. The right-side fuel passage 16 is branched at a right angle at positions corresponding to the injectors 3 of the cylinder #1 and the cylinder #2 in the left-right direction, a downstream insertion hole 18 with a circular section is communicably formed at each branched location and is opened from the outer side surface of the right-side delivery pipe 4R toward each corresponding injector 3. In the present embodiment, a total of four downstream insertion holes 18 including the downstream insertion holes 18 of the left-side delivery pipe 4L correspond to the fuel outlet ports according to the present invention.

Also, the left-side delivery pipe 4L has a horizontally symmetrical shape with respect to the right-side delivery pipe 4R as described above, corresponds to the injectors 3 of the cylinder #3 and the cylinder #4, and an upstream insertion hole 17 opened rightward from the right end surface thereof faces the upstream insertion hole 17 on the side of the right-side delivery pipe 4R.

On the other hand, the fuel inlet port 15 includes a base portion 15*a*, a nipple portion 15*b* directed backward from the base portion 15*a*, and a pair of left and right cylindrical portions 15*c* directed leftward and rightward from the base portion 15*a*. The nipple portion 15*b* and each cylindrical portion 15*c* communicate with each other via an internal passage 15*d*, and an O-ring 19 is fitted to each cylindrical portion 15*c*. Note that the left-side and right-side delivery pipes 4L and 4R and the fuel inlet port 15 according to the present embodiment are integrally formed through injection molding of a synthetic resin material, but the manufacturing method is not limited thereto and can be modified in various manners.

Figure 10:
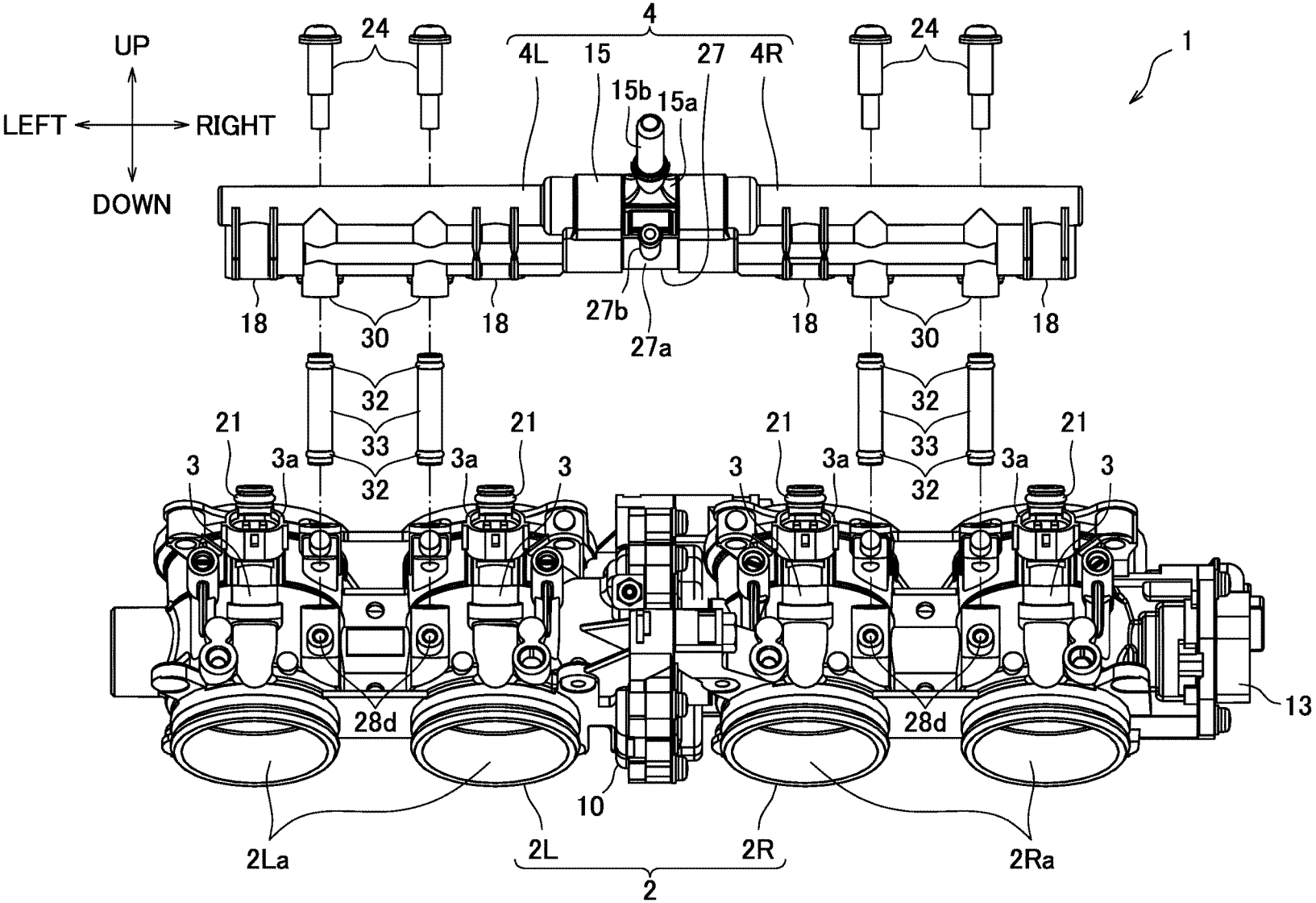
FIG. 10 is an exploded view illustrating a state in which the connection pipe and the delivery pipe have been detached from the throttle body.

As illustrated in FIGS. 10 and 11, the left-side and right-side delivery pipes 4L and 4R are disposed with the fuel inlet port 15 sandwiched from the left and right sides, and each cylindrical portion 15*c* of the fuel inlet port 15 is inserted into each upstream insertion hole 17 of the delivery pipe 4 and is held in a liquid tight manner by the O-ring 19. A fuel passage 20 with a shape branched into two directions from the nipple portion 15*b* of the fuel inlet port 15 to the left and right cylindrical portions 15*c* and further branched into two directions from each of the left and right fuel passages 16 communicating with the upstream insertion holes 17 to each downstream insertion hole 18 is formed inside the delivery pipe 4 configured as described above.

Figure 6:
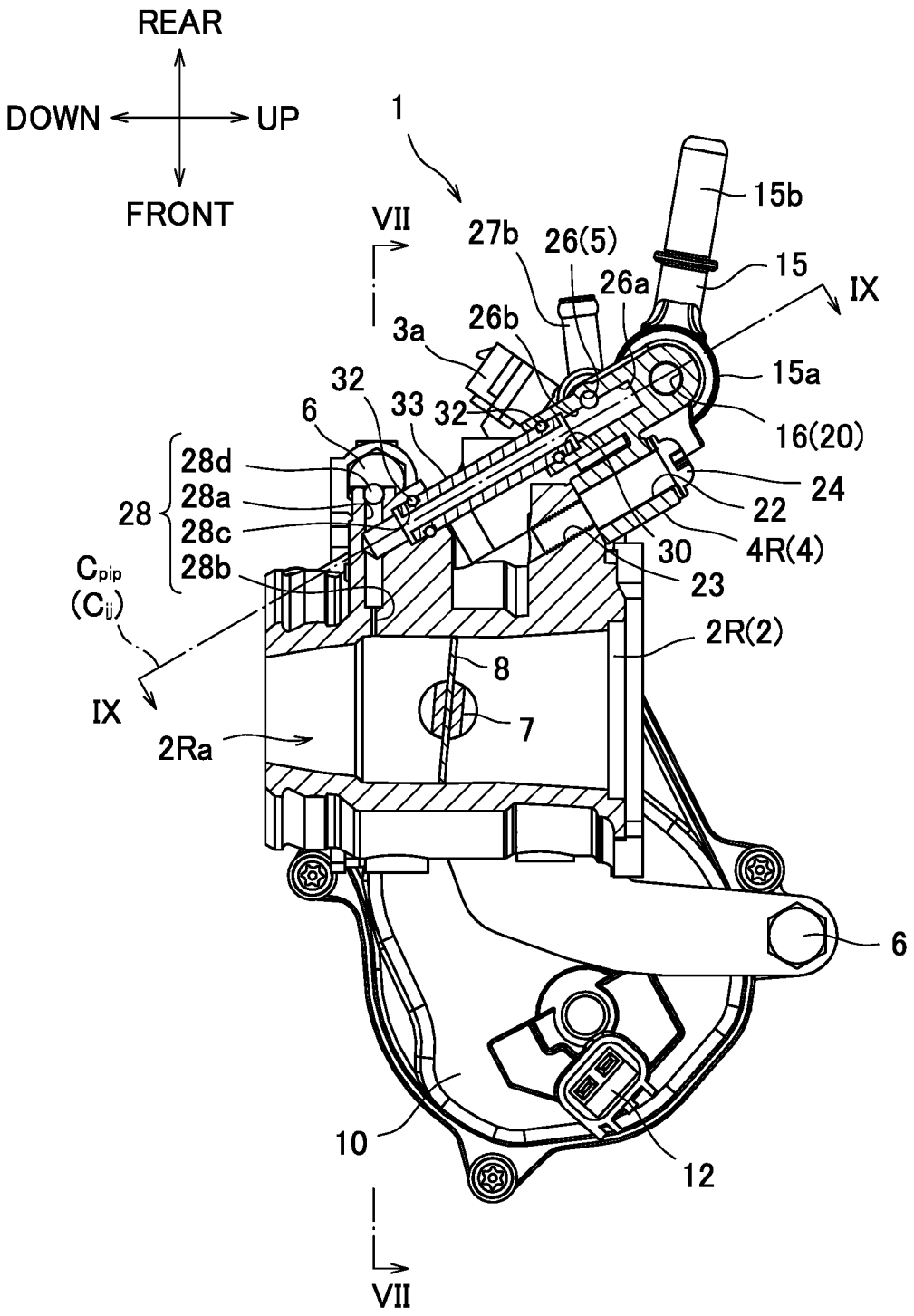
FIG. 6 is a sectional view illustrating a state in which a connection pipe and the delivery pipe are attached to the throttle body and taken along the line VI-VI in FIG. 2.

As illustrated in FIGS. 5 and 8, an O-ring 21 is fitted to proximal end of each injector 3 and is inserted into each of the downstream insertion holes 18 of the left-side and right-side delivery pipes 4L and 4R in a state in which the O-ring 21 is held in a liquid tight manner. As illustrated in FIGS. 5 and 6, a screw hole 22 is provided to penetrate along an axial line Cij of each injector 3 at a position in front of each downstream insertion hole 18 of the delivery pipe 4, and a female screw portion 23 is formed in the throttle body 2 to correspond to each screw hole 22. A screw 24 is screwed into each female screw portion 23 via the screw hole 22, and the delivery pipe 4 is thereby attached to the throttle body 2.

In a mounted state in the vehicle body of the motorcycle, a fuel hose from a fuel tank, which is not illustrated, is connected to the nipple portion 15*b* of the fuel inlet port 15. In the present embodiment, the nipple portion 15*b* corresponds to the connection portion according to the present invention. Since the nipple portion 15*b* has an angle that is freely changed around an axial line of the cylindrical portion 15*c*, it is possible to arrange the fuel hose without causing an unnatural bending. When the engine is operated, the fuel stored in the fuel tank is pressurized by a fuel pump, flows from the fuel hose into the fuel inlet port 15, is further branched by the fuel passage 20 inside the delivery pipe 4, and is supplied to each injector 3 of each cylinder. In this manner, the fuel injection is performed by the injectors 3 described above.

On the other hand, a transpiration gas treatment device, which is not illustrated, to treat transpiration gas generated inside the fuel tank or the like is mounted in the vehicle body of the motorcycle. In order to burn transpiration gas adsorbed by a canister of the transpiration gas treatment device inside each cylinder of the engine, the intake device 1 includes a transpiration gas passage branching and guiding the transpiration gas from the canister to the bores 2La and 2Ra of the throttle body 2. Although a configuration in which rubber hoses are combined into a branched shape is described as a transpiration gas passage in Patent Document 1, the transpiration gas passage 5 is formed instead inside the delivery pipe 4, according to the present embodiment, and details thereof will be described below.

In short, the transpiration gas passage 5 is formed by causing a passage to be successively branched inside the delivery pipe 4 similarly to the fuel passage 20. In order to cause the transpiration gas from the canister to flow in each of transpiration gas passages 26 formed in the left-side and right-side delivery pipes 4L and 4R, a transpiration gas inlet port 27 is added as a constituent component of the delivery pipe 4. In the present embodiment, the transpiration gas passage 5 corresponds to the intake pipe communication passage according to the present invention, and the transpiration gas inlet port 27 corresponds to the collecting connection port according to the present invention.

Figure 7:
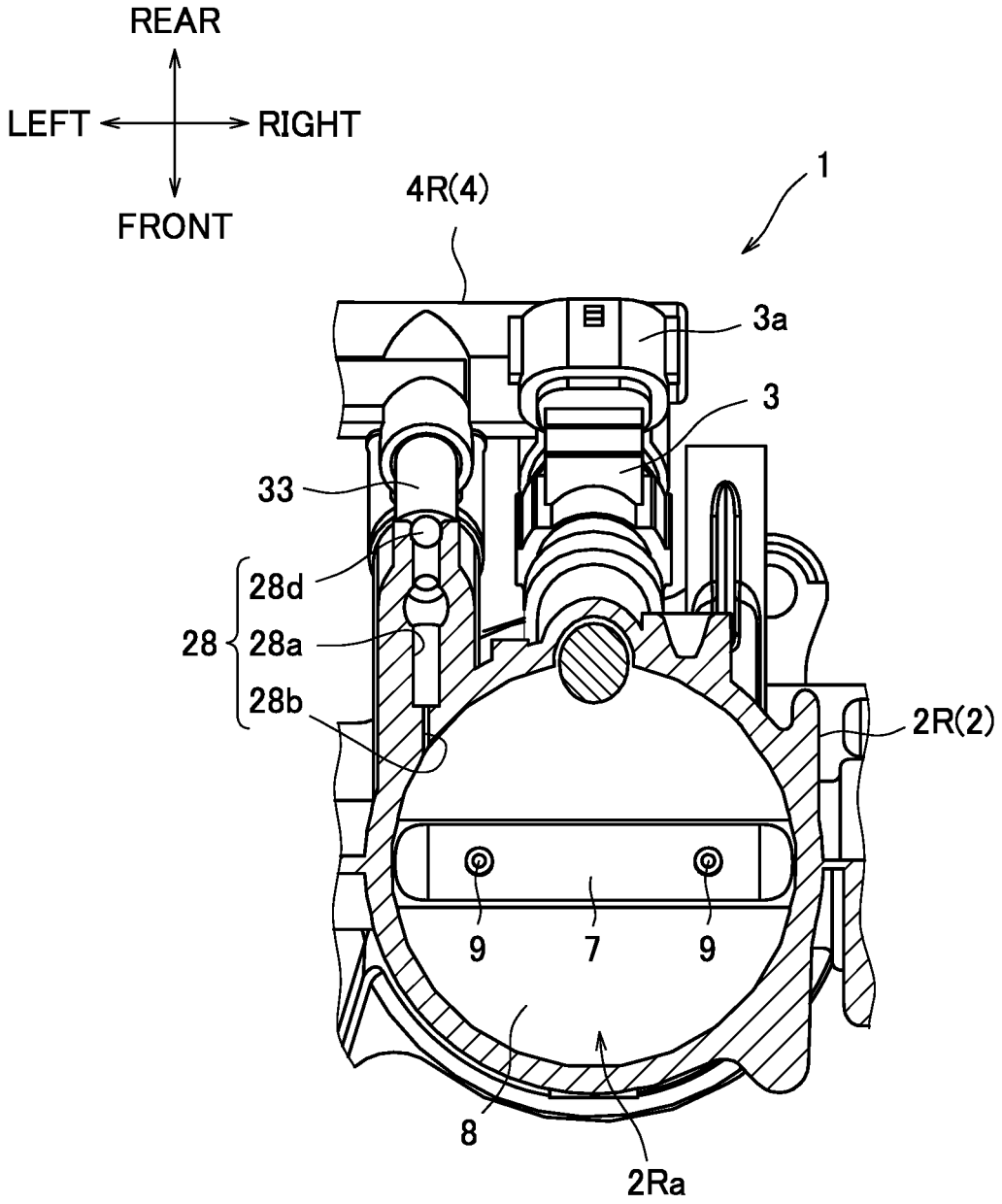
FIG. 7 is a sectional view illustrating a transpiration gas relay passage formed in the throttle body and taken along the line VII-VII in FIG. 6.

As illustrated in FIGS. 6 and 7, a transpiration gas relay passage 28 for guiding the transpiration gas from the delivery pipe 4 to each of the bores 2La and 2Ra is formed in the throttle body 2. A vertical passage 28*a* is bored from the rear side at a left-side position or a right-side position of each injector 3 of the throttle body 2, and the rear end of the vertical passage 28*a* is blocked by a plug 28*d*. A reducing passage 28*b* is continuous forward with the front end of the vertical passage 28*a*, and the front end of the reducing passage 28*b* is opened at a position further downstream in the intake air flowing direction than the throttle valves 8 in the bores 2La and 2Ra. A transpiration gas receiving port 28*c* with a circular sectional shape that communicates with each vertical passage 28*a* is formed in the throttle body 2, and each transpiration gas receiving port 28*c* is opened toward the obliquely upper rear side, in other words, toward the side of the delivery pipe 4.

The transpiration gas relay passage 28 is formed by these vertical passage 28*a*, the reducing passage 28*b*, the transpiration gas receiving port 28*c*, and the plug 28*d* to correspond to each cylinder on the throttle body 2. In the present embodiment, the total of four transpiration gas receiving ports 28*c* correspond to the throttle body-side connection ports according to the present invention.

Although the left and right transpiration gas passages 26 formed at the left-side and right-side delivery pipes 4L and 4R will be described next, the left and right transpiration gas passages 26 also have horizontally symmetrical shapes similarly to the left and right fuel passages 16, and the right-side delivery pipe 4R will thus be described as a representative.

Figure 9:
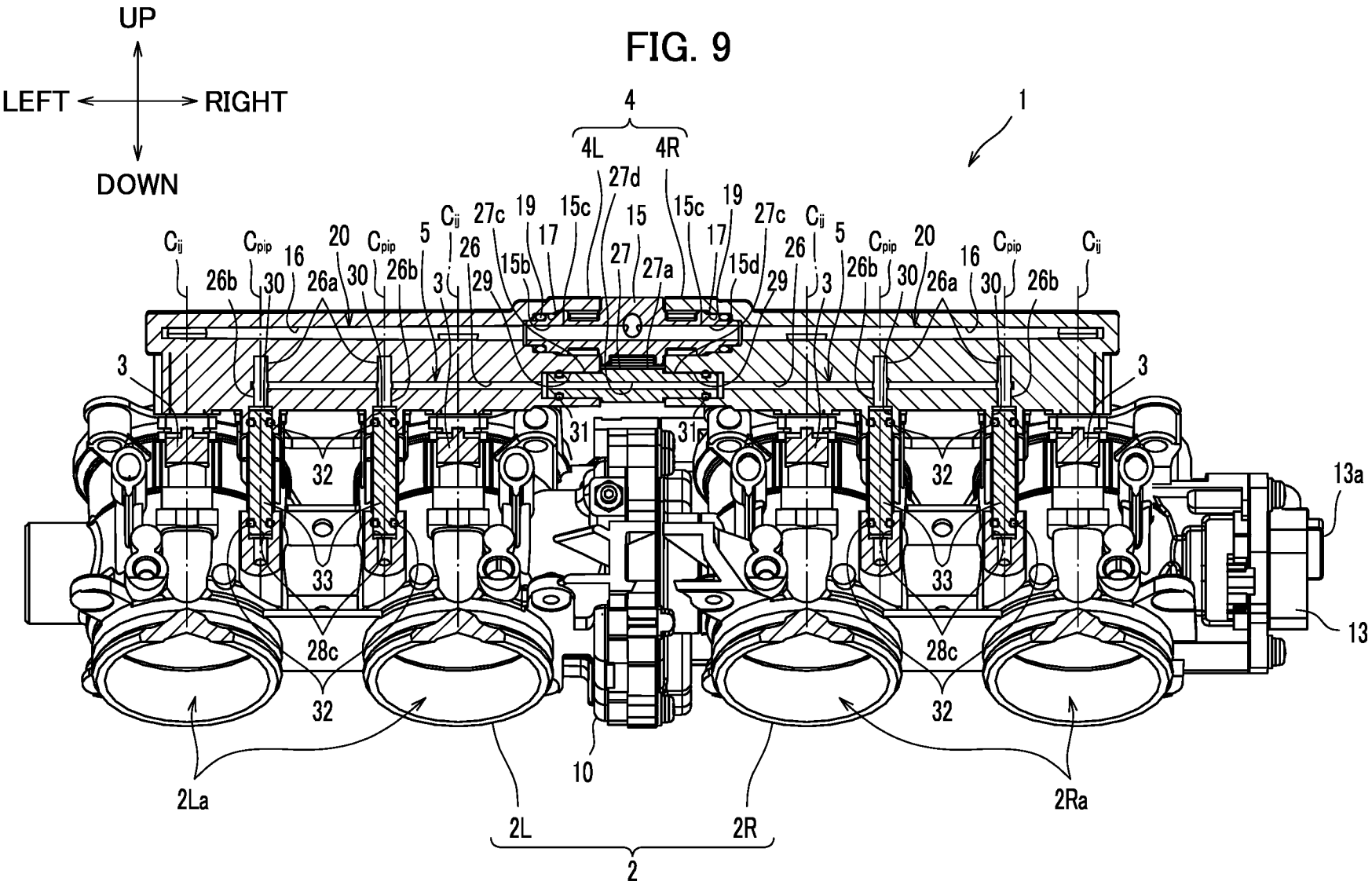
FIG. 9 is a sectional view illustrating a transpiration gas passage of the delivery pipe and each connection pipe communicate with each other and taken along the line IX-IX in FIG. 6.

As illustrated in FIGS. 6, 9, and 11, the right-side transpiration gas passage 26 is disposed at a position lower than the right-side fuel passage 16 of the right-side delivery pipe 4R. Specifically, the right-side transpiration gas passage 26 is formed to follow the longitudinal direction of the right-side delivery pipe 4R at a position below the right-side fuel passage 16. An upstream insertion hole 29 with a circular sectional shape is communicably formed at the left end of the right-side transpiration gas passage 26 and is opened leftward from the left end surface of the right-side delivery pipe 4R. The right-side transpiration gas passage 26 is branched at a right angle to both sides facing at 1800 at the positions corresponding to the transpiration gas receiving ports 28*c* of the cylinder #1 and the cylinder #2 in the left-right direction, and each branched location 26*a* on one side is blocked.

A downstream insertion hole 30 with a circular sectional shape is communicably formed at a branched location 26*b* on the other side and is opened from the outer side surface of the right-side delivery pipe 4R toward each corresponding transpiration gas receiving port 28*c*. In the present embodiment, a total of four downstream insertion holes 30 including the downstream insertion holes 30 of the left-side delivery pipe 4L correspond to the delivery pipe-side connection ports according to the present invention. The left-side delivery pipe 4L has a horizontally symmetrical shape with respect to the right-side delivery pipe 4R described above and corresponds to the transpiration gas receiving ports 28*c* of the cylinder #3 and the cylinder #4, and the upstream insertion hole 29 opened at the right end surface thereof faces the upstream insertion hole 29 on the side of the right-side delivery pipe 4R.

On the other hand, the transpiration gas inlet port 27 includes a base portion 27*a*, a nipple portion 27*b* directed backward from the base portion 27*a*, and a pair of left and right cylindrical portions 27*c* directed leftward and rightward from the base portion 27*a*. The nipple portion 27*b* and each cylindrical portion 27*c* communicate with each other via an internal passage 27*d*, and an O-ring 31 is fitted to each cylindrical portion 27*c*. As a result, the left-side and right-side cylindrical portions 27*c* of the transpiration gas inlet port 27 are parallel to the left-side and right-side cylindrical portions 15*c* of the fuel inlet port 15, respectively. Therefore, if the fuel inlet port 15 and the transpiration gas inlet port 27 are sandwiched by the left-side and right-side delivery pipes 4L and 4R in an assembly operation, which will be described later, then the corresponding cylindrical portions 15*c* and 27*c* are inserted into the upstream insertion holes 17 and 29 of the delivery pipes 4L and 4R at the same time. Note that although the transpiration gas inlet port 27 is also integrally formed through injection molding of a synthetic resin material, the manufacturing method is not limited thereto and can be modified in various manners.

Also, the left-side and right-side delivery pipes 4L and 4R are disposed with the transpiration gas inlet port 27 sandwiched from the left and right sides along with the fuel inlet port 15, and each cylindrical portion 27*c* of the transpiration gas inlet port 27 is inserted into each upstream insertion hole 29 of the delivery pipe 4 and is held by the O-ring 31 with air tightness. As a result, a transpiration gas passage 5 with a shape branched into two directions from the nipple portion 27*b* to the left and right cylindrical portions 27*c* of the transpiration gas inlet port 27 and further branched into two directions from each of the left and right transpiration gas passages 26 communicating with each upstream insertion hole 29 to each downstream insertion hole 30 is formed inside the delivery pipe 4.

Figure 12:
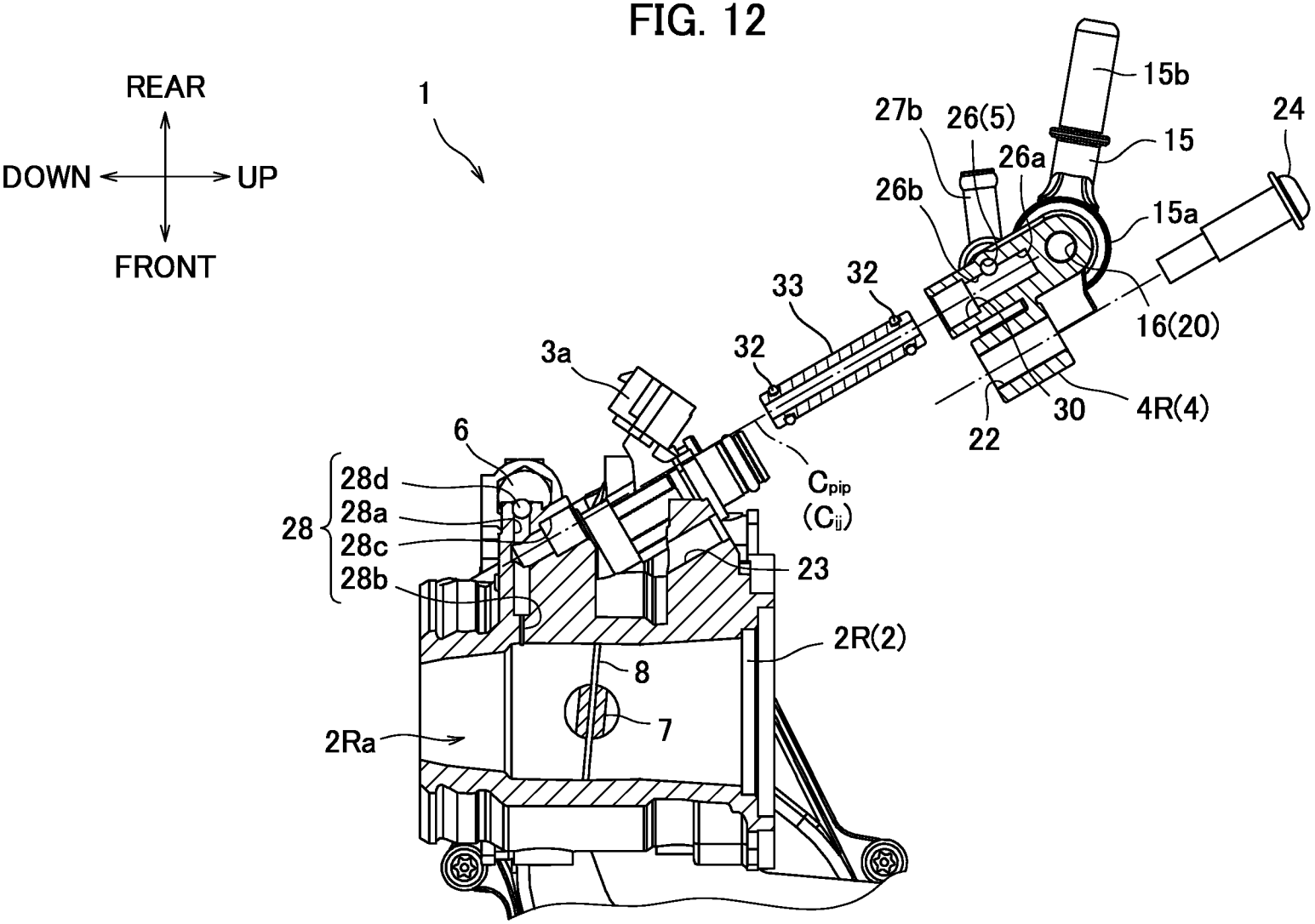
FIG. 12 is an exploded view illustrating a state in which the connection pipe and the delivery pipe have been detached from the throttle body and corresponding to FIG. 6.

As illustrated in FIGS. 6, 10, and 12, each downstream insertion hole 30 of the transpiration gas passage 5 faces the corresponding transpiration gas receiving port 28*c* on the side of the throttle body 2 with a predetermined interval therebetween, and a connection pipe 33 with a cylindrical shape and with O-rings 32 fitted thereto at both ends is disposed therebetween. One end of each connection pipe 33 is inserted into the corresponding downstream insertion hole 30 on the side of the delivery pipe 4 in a state in which the one end is held with air tightness, and the other end of each connection pipe 33 is inserted into the corresponding transpiration gas receiving port 28*c* on the side of the throttle body 2 in a state in which the other end is held with air tightness.

An axial line Cpip of each connection pipe 33 is set to be parallel to the axial line Cij of each injector 3. If the delivery pipe 4 with one end of the connection pipe 33 inserted into each downstream insertion hole 30 in advance is attached to the throttle body 2 in an assembly operation, which will be described later, then proximal end of the injector 3 is inserted into each downstream insertion hole 18 of the delivery pipe 4, and the other end of each connection pipe 33 is inserted into each transpiration gas receiving port 28*c* on the side of the throttle body 2 at the same time.

The reason that each connection pipe 33 is a component separated from the delivery pipe 4 is to absorb axial line deviation between the transpiration gas receiving port 28*c* and the downstream insertion hole 30. In other words, a deviation may cause between the axial line of each transpiration gas receiving port 28*c* and the axial line of each downstream insertion hole 30 due to fabrication errors and the like of the throttle body 2 and the delivery pipe 4, and each deviation is not always generated in the same direction. Since the connection pipes 33 are individually and slightly inclined with air tightness kept by the O-rings 32 in accordance with such an axial line deviation and absorb the axial line deviation, it is possible to achieve an intended function of guiding the transpiration gas even in a case in which fabrication errors or the like occur.

In the mounted state in the vehicle body of the motorcycle, a transpiration gas hose 25 from the canister of the transpiration gas treatment device, which is not illustrated, is connected to the nipple portion 27*b* of the transpiration gas inlet port 27 as illustrated in FIG. 1. In the present embodiment, the nipple portion 27*b* corresponds to the connection portion according to the present invention. Since the nipple portion 27*b* has an angle that is freely changed around the axial line of the cylindrical portion 27*c*, the transpiration gas hose 25 can be arranged without unnatural bending.

Also, the canister of the transpiration gas treatment device communicates with the inside of the bores 2La and 2Ra via the path including the transpiration gas hose 25, the transpiration gas passage 5 of the delivery pipe 4, each connection pipe 33, and each transpiration gas relay passage 28 on the side of the throttle body 2. If the engine is operated, then a negative pressure generated inside the bores 2La and 2Ra of the throttle body 2 follows backward through the aforementioned path and acts on the canister, and the adsorbed transpiration gas flows into the nipple portion 27*b* of the transpiration gas inlet port 27 through the transpiration gas hose 25.

The transpiration gas that has flows into the nipple portion 27*b* is branched into the left and right cylindrical portions 27*c* through the internal passage 27*d* and is then guided to the left and right transpiration gas passages 26 of the delivery pipe 4. Then, the transpiration gas distributed rightward through the right-side transpiration gas passage 26 is partially guided to the downstream insertion hole 30 at the branched location 26*b* corresponding to the cylinder #2, and the remaining transpiration gas is further distributed rightward through the transpiration gas passage 26 and is then guided to the downstream insertion hole 30 at the branched location 26*b* corresponding to the cylinder #1. Similarly, the transpiration gas distributed leftward through the left-side transpiration gas passage 26 is partially guided to the downstream insertion hole 30 at the branched location 26*b* corresponding to the cylinder #3, and the remaining transpiration gas is further distributed leftward through the transpiration gas passage 26 and is guided to the downstream insertion hole 30 at the branched location 26*b* corresponding to the cylinder #4.

The transpiration gas guided to these downstream insertion holes 30 is guided to the side of the throttle body 2 through each connection pipe 33 and then flows into the transpiration gas receiving port 28*c* of each transpiration gas relay passage 28. Then, the transpiration gas is supplied from each transpiration gas receiving port 28*c* to the inside of each of the bores 2La and 2Ra through the vertical passage 28*a* and the reducing passage 28*b*, is introduced into the cylinder of the engine along with the air-fuel mixture, and is burned and treated. Note that the reducing passage 28*b* at this time has a function of adjusting the amount of transpiration gas supplied to the inside of each of the bores 2La and 2Ra.

Next, the intake device 1 for a four-cylinder engine according to the present embodiment configured as described above will be compared with the intake device in Patent Document 1 in terms of manufacturing cost and assembly operability, in particular.

First, the manufacturing cost will be described. The intake device in Patent Document 1 requires a large number of components including three three-way nipples, six rubber hoses, and twelve clips to construct the transpiration gas passage. On the other hand, according to the intake device 1 according to the present embodiment, the delivery pipe 4 is an existing component, and constituent components to be added are thus only the transpiration gas inlet port 27 including the O-ring 31 and the four connection pipes 33 similarly including the O-rings 32. Also, although it is necessary to newly form the transpiration gas passage 5, specifically, the transpiration gas passage 26 and each downstream insertion hole 30 inside the delivery pipe 4, it is possible to easily handle this formation by changing a mold shape or the like in injection molding. As a result, according to the intake device 1 of the present embodiment, it is possible to significantly reduce the number of constituent components as compared with that in Patent Document 1.

Also, the intake device in Patent Document 1 requires expensive rubber hoses with fluorine resin layers formed on inner surfaces thereof in order to prevent transpiration gas from leaking. The function of the rubber hoses is achieved by the delivery pipe 4 in the present embodiment, and the delivery pipe 4 inside which gasoline that is a fuel is caused to be distributed is originally made of a synthetic resin material with a resistance against gasoline, and the material also has a property of blocking the transpiration gas as well. Therefore, the delivery pipe 4 can be caused to function as the transpiration gas passage 5 without any change in material, which does not lead to an increase in cost.

According to the intake device in Patent Document 1, the transpiration gas passage is constructed by combining the rubber hoses in the branched shape, and it is thus necessary to perform stock management for a plurality of types of rubber hoses with different lengths and shapes. Such a transpiration gas passage in Patent Document 1 is replaced with the existing delivery pipe 4 in the present embodiment, and the number of components as targets of stock management is thus significantly reduced. All the aforementioned factors can result in a decrease in manufacturing cost of the intake device 1 as compared with Patent Document 1.

In addition, such advantages of the present embodiment in regard to stock management are more significantly obtained in a case in which a plurality of types of throttle bodies 2 with different specifications are produced.

In other words, specifications of the throttle bodies 2 of these types are set on the basis of requests from the engine side or positional relationships and the like with peripheral members in the vehicle-mounted state. Therefore, for an engine with a different pitch of cylinder bores, for example, pitches of the bores 2La and 2Ra of each throttle body 2 are set correspondingly. There is also a case in which a separation distance or the like between the throttle body 2 and the delivery pipe 4, for example, is changed for the purpose of preventing an interference between the throttle body 2 or the delivery pipe 4 and the peripheral members in the vehicle-mounted state.

In a case of producing throttle bodies 2 of such multiple types of specifications, the shape of the transpiration gas passage 5 is different for each specification, and it is thus necessary to prepare a huge number of rubber hoses with corresponding lengths and shapes in the intake device in Patent Document 1, which requires significantly complicated stock management. On the other hand, according to the present embodiment, it is possible to address this problem merely by preparing the delivery pipe 4 having the transpiration gas passage 5 corresponding to the specification of the throttle body 2, and it is possible to significantly reduce the number of components that are targets of stock management, and thereby to remarkably reduce time and efforts for the stock management as a result.

Note that it is desirable that the delivery pipe 4 be shared as much as possible among the throttle bodies 2 with different specifications. Thus, in a case in which the separation distance between the throttle body 2 and the delivery pipe 4 is different, for example, the delivery pipe 4 is shared, and the difference is addressed by changing the position and the shape of the transpiration gas receiving port 28*c* in the throttle body 2, by changing the length of the connection pipe 33, or the like. Also, in a case in which the pitches of the bores 2La and 2Ra of the throttle are different, for example, it is difficult to share the delivery pipe 4, and therefore the delivery pipes 4 corresponding to the bore pitches are to be individually prepared.

On the other hand, the assembly operability will be described. For example, the intake device 1 according to the present embodiment is assembled in accordance with the following procedure.

First, the left-side and right-side throttle bodies 2L and 2R are coupled, the throttle valves 8, the throttle shaft 7, and the like are incorporated therein, and the injectors 3, the motor 11, and the like are attached to the outside thereof, thereby assembling the throttle body 2.

In parallel to this, the delivery pipe 4 is temporarily assembled. Specifically, the O-rings 19, 31, and 32 are fitted to the cylindrical portions 15*c* and 27*c* of the fuel inlet port 15 and the transpiration gas inlet port 27 and both ends of each connection pipe 33 in advance, and the O-ring 21 is also fitted to the proximal end of each injector 3 on the side of the throttle body 2. The fuel inlet port 15 and the transpiration gas inlet port 27 are sandwiched from the left and right sides with the left-side and right-side delivery pipes 4L and 4R, and the cylindrical portions 15*c* and 27*c* thereof are inserted into the upstream insertion holes 17 and 29. Also, one end of the connection pipe 33 is inserted to each of the downstream insertion holes 30 of the left-side and right-side delivery pipes 4L and 4R. In the temporarily assembled state, dropping of the cylindrical portions 15*c* and 27*c* from the upstream insertion holes 17 and 29 and dropping of the connection pipe 33 from the downstream insertion hole 30 are not prevented.

Then, if the delivery pipe 4 is disposed at a normal position on the throttle body 2, then the proximal end of each corresponding injector 3 is inserted into each downstream insertion hole 18 of the delivery pipe 4, and the other end of each connection pipe 33 is inserted into each corresponding transpiration gas receiving port 28*c* on the side of the throttle body 2. In addition, if each screw hole 22 on the side of the delivery pipe 4 conforms to each female screw portion 23 on the side of the throttle body 2, and the delivery pipe 4 is secured to the throttle body 2 with the screw 24, then the series of assembly operations are completed.

In the assembly completed state, the positional relationship of the delivery pipe 4 relative to the throttle body 2 is defined, and the positional relationship between the left-side delivery pipe 4L and the right-side delivery pipe 4R is also defined via the throttle body 2. Therefore, separation between the left-side delivery pipe 4L and the right-side delivery pipe 4R and thus dropping of the cylindrical portions 15*c* and 27*c* of the fuel inlet port 15 and the transpiration gas inlet port 27 from the upstream insertion holes 17 and 29 of each delivery pipe 4 are prevented. Also, separation of the delivery pipe 4 from the throttle body 2 and thus dropping of one end of the connection pipe 33 from each downstream insertion hole 30 of the delivery pipe 4 and dropping of the other end of the connection pipe 33 from each transpiration gas receiving port 28*c* of the throttle body 2 are prevented.

If the content of the aforementioned assembly operation is compared with an assembly operation of an ordinary delivery pipe that has only a fuel distributing function, for example, the delivery pipe in Patent Document 1, only a few operations in regard to the connection pipe 33 are added. Specifically, when the left and right cylindrical portions 15*c* of the fuel inlet port 15 are inserted into the upstream insertion holes 17 of the left-side and right-side delivery pipes 4L and 4R in the delivery pipe in Patent Document 1, the left and right cylindrical portions 27*c* of the transpiration gas inlet port 27 are also naturally inserted into the corresponding upstream insertion holes 29 in the present embodiment. Also, since the cylindrical portion 27*c* of the transpiration gas inlet port 27 is sandwiched by the left and right upstream insertion holes 29 and is prevented from dropping therefrom as described above, there is no need to perform a special operation to prevent the dropping, and new efforts are not required in regard to the assembly operation at this time.

Also, when the proximal end of the injector 3 is inserted into each downstream insertion hole 18 in the delivery pipe in Patent Document 1, the other end of each connection pipe 33 is naturally inserted to each transpiration gas receiving port 28*c* of the throttle body 2 in the present embodiment. Also, since the one end and the other end of the connection pipe 33 are sandwiched between the downstream insertion hole 30 and the transpiration gas receiving port 28*c* and are prevented from dropping therefrom as described above, there is no need to perform a special operation to prevent the dropping. The one end of each connection pipe 33 is to be inserted into the downstream insertion hole 30 of the delivery pipe 4 as an only operation to be performed in advance, and it is thus possible to consider that there is substantially no increase in time and efforts.

Thus, it is possible to construct the transpiration gas passage 5 along with the fuel passage 20 on the throttle body 2 in accordance with such simple operation content that is comparable with the operation of assembling the delivery pipe in Patent Document 1. Therefore, time and efforts required by the assembly operation are remarkably reduced as compared with Patent Document 1 in which an operation of attaching the large number of clips to the rubber hoses is required.

Furthermore, according to the intake device in Patent Document 1, it is necessary to attach the transpiration gas passage in an environment of a narrowed operation space due to the delivery pipe that has already been attached to the throttle body. On the other hand, according to the embodiment, it is possible to construct the transpiration gas passage 5 at the same time as the attachment of the delivery pipe in an environment in which a sufficient operation space is secured in the surroundings, this remarkably facilitates the assembly operation, and it is thus possible to realize satisfactory assembly operability.

Although the intake air pressure collecting passage that causes the bores 2La and 2Ra and the pressure sensor to communicate with each other is not provided in the throttle body 2 in the present embodiment, an intake air pressure collecting passage with a branched shape is provided using rubber hoses in a case in which an intake air negative pressure is used as one piece of information for engine control. However, in a case in which such an intake air pressure collecting passage is provided in the throttle body 2, a necessity to avoid the intake air pressure collecting passage in addition to the delivery pipe occurs when the transpiration gas passage is assembled in the intake device in Patent Document 1, which requires an operation that is very difficult to be performed. On the other hand, according to the present embodiment, it is only necessary to avoid only the intake air pressure collecting passage when the delivery pipe 4 is assembled, and the assembly operation is thus remarkably easily performed. As a result, according to the present embodiment, it is possible to realize satisfactory assembly operability even in such a case in which the intake air pressure collecting passage is added and the operation space is further narrowed.

Note that the assembly operation is not limited to the aforementioned procedure and can be modified in various manners. For example, the delivery pipe 4 may be assembled with the throttle body 2 for which attachment to the engine has been completed, or alternatively, the other end of each connection pipe 33 may be inserted into the transpiration gas receiving port 28*c* of the throttle body 2 in advance instead of inserting the one end of each connection pipe 33 into the downstream insertion hole 30 of the delivery pipe 4 in advance. The aforementioned effects and advantages can be achieved regardless of which of the procedures is employed.

On the other hand, no need to construct the transpiration gas passage 5 separately from the delivery pipe 4 leads to a margin of the space in the throttle body 2. In a case in which both the transpiration gas passage 5 and the intake air pressure collecting passage are provided in the throttle body 2, for example, it is necessary not only to secure the installation spaces thereof but also to take a measure to prevent mutual contact due to vibration, such as attachment of a protector. If the transpiration gas passage 5 is formed in the delivery pipe 4, it is possible to easily secure the space for the intake air pressure collecting passage in the throttle body 2 and to eliminate the need to attach the protector. On the contrary even when the intake air pressure collecting passage is formed in the delivery pipe 4, similar advantages can be obtained in regard to the installation space of the transpiration gas passage and the attachment of the protector.

Although the rubber hoses of the transpiration gas passage are prevented from being pulled out using the clips in the intake device in Patent Document 1, it is difficult to state that this is a reliable measure. For example, in a case in which the clip attachment position is inappropriate, a clearance may occur. In a case in which the rubber hoses are pulled for some reasons during the operation, the hoses are pulled out and drop. Both cases may be direct reasons for leakage of the transpiration gas. On the other hand, according to the intake device 1 of the present embodiment, the cylindrical portion 27*c* of the transpiration gas inlet port 27 is sandwiched between the left and right upstream insertion holes 29 and is prevented from dropping, and the one end and the other end of the connection pipe 33 is sandwiched between the downstream insertion hole 30 and the transpiration gas receiving port 28*c* and are prevented from dropping as described above. Therefore, since the liquid-tight and air-tight preventing effects of the O-rings 31 and 32 are reliably achieved at both the locations, and another advantage that it is possible to prevent leakage of the transpiration gas and to improve reliability of the intake device 1 can also be obtained.

Aspects of the present invention are not limited to the embodiment. For example, although the aforementioned embodiment is implemented as the intake device 1 for an in-line four-cylinder engine mounted in a motorcycle, the application, the engine type, and the like are not limited thereto and can be arbitrarily modified. For example, the invention may be applied to an intake device for an engine mounted in an all-terrain vehicle (ATV) such as a four-wheeled buggy or may be applied to an intake device for an engine with a different number of cylinders or different cylinder alignment.

Although the transpiration gas passage 5 is formed in addition to the existing fuel passage 20 in the delivery pipe 4 in the aforementioned embodiment, it is also possible to form the aforementioned intake air pressure collecting passage. In the case in which the intake air pressure collecting passage instead of the transpiration gas passage 5, for example, it is possible to address the case merely by connecting a pressure sensor 41 that detects an intake air pressure to the nipple portion 27*b* of the transpiration gas inlet port 27 with the configuration in the embodiment basically maintained as illustrated in FIG. 1. With this configuration, the intake air pressures generated inside the bores 2La and 2Ra of the throttle body 2 are guided to the transpiration gas receiving port 28*c* of the transpiration gas relay passage 28, and each of the intake air pressures flows into the downstream insertion hole 30 of the delivery pipe 4 through the connection pipe 33. The intake air pressures from the downstream insertion holes 30 are merged in the process of distribution through the transpiration gas passage 5 and act on the pressure sensor 41 through the transpiration gas inlet port 27. It is thus possible to detect the intake air pressures as one piece of information for engine control.

Therefore, each transpiration gas receiving port 28*c* of the throttle body 2 corresponds to the intake air pressure extraction port according to the present invention for extracting the intake air pressure generated inside the bores 2La and 2Ra and thus the throttle body-side connection port according to the present invention in this example. Also, each downstream insertion hole 30 of the delivery pipe 4 corresponds to the delivery pipe-side connection port according to the present invention to which the intake air pressure from the intake air pressure extraction port is guided. Also, the transpiration gas passage 5 of the delivery pipe 4 corresponds to the intake air pressure collecting passage according to the present invention that causes the intake air pressures guided from each intake air pressure extraction port to the delivery pipe-side connection port to be merged and thus the intake pipe communication passage according to the present invention. Also, the transpiration gas inlet port 27 corresponds to the sensor connection port according to the present invention to which the pressure sensor 41 is connected and the intake air pressure merged by the intake air pressure collecting passage is guided and thus the collecting connection port according to the present invention.

In a case in which the intake air pressure collecting passage is formed in addition to the fuel passage 20 and the transpiration gas passage 5 in the delivery pipe 4, it is only necessary to newly add the intake air pressure collecting passage as described above to the configuration in the embodiment. Although the description will not be repeated, it is possible to realize a further decrease in manufacturing cost and a further improvement in assembly operability as compared with the embodiment since the number of components constituting the intake air pressure collecting passage is significantly reduced in this case.

Although the delivery pipe 4 is split into the left-side and right-side delivery pipes 4L and 4R, and the transpiration gas is branched from the transpiration gas inlet port 27 provided therebetween to the left and right transpiration gas passages 26 in the aforementioned embodiment, the configuration of the transpiration gas passage 5 is not limited thereto. For example, a single delivery pipe 4 may be provided for a four-cylinder engine or a two-cylinder engine as a target, the transpiration gas hose 25 may be connected to a left end or a right end thereof to guide the transpiration gas to the transpiration gas passage 26 therein, and the transpiration gas may be successively branched to each cylinder in the process of the transpiration gas distributed through the transpiration gas passage 26. It is possible to construct the transpiration gas passage 5 with a yet easier configuration by eliminating the splitting of the delivery pipe 4. Also, the fuel inlet port 15 may be disposed between the left-side and right-side delivery pipes 4L and 4R, and the transpiration gas hose 25 may be connected to the left end or the right end of the delivery pipe 4, or an opposite connection state thereof may be employed, for example.

Figure 13:
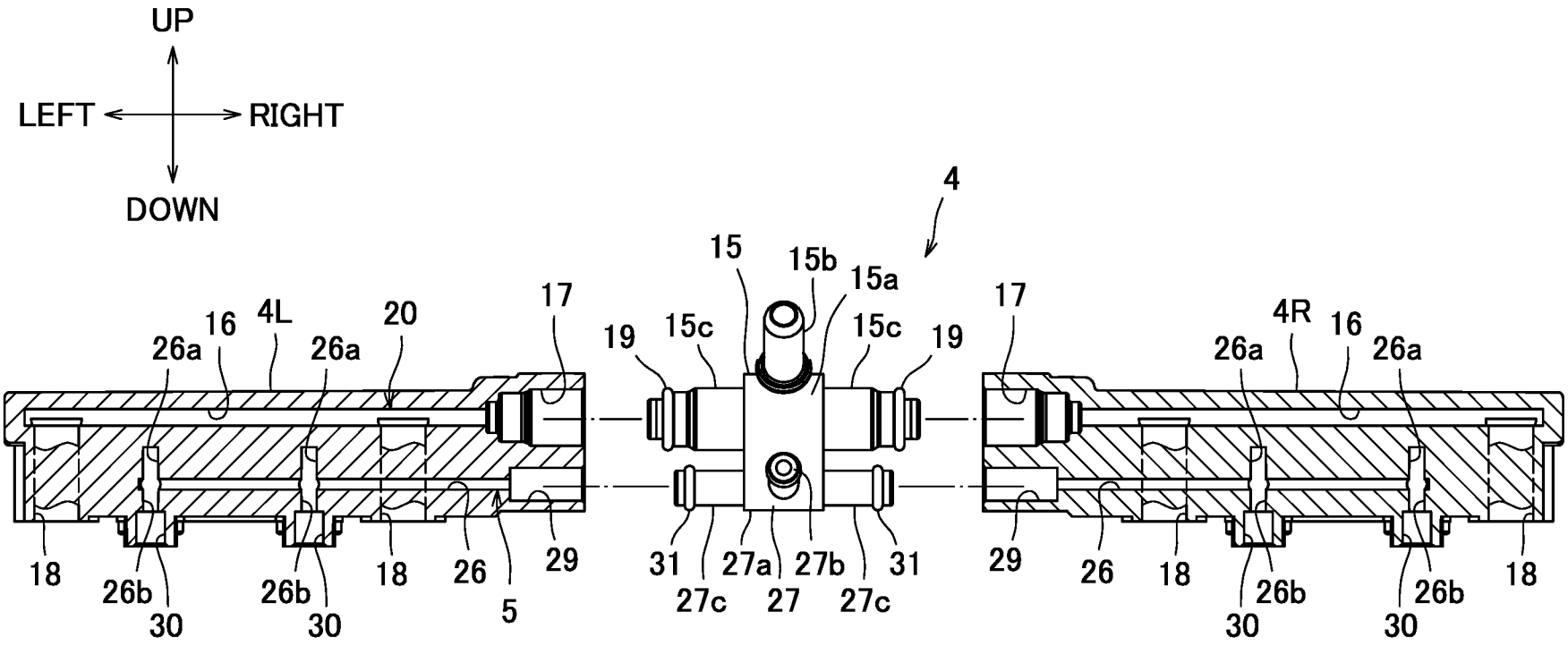
FIG. 13 is an exploded view illustrating another example in which the fuel inlet port and the transpiration gas inlet port are configured as an integrated component and corresponding to FIG. 11.

Although the fuel inlet port 15 and the transpiration gas inlet port 27 are separate components in the aforementioned embodiment, the fuel inlet port 15 and the transpiration gas inlet port 27 may be an integrated component as illustrated in FIG. 13. In this case, it is necessary to cause the inter-axis distance between the upstream insertion holes 17 and 29 on the side of the delivery pipe 4 to conform to the inter-axis distance between the cylindrical portion 15*c* on the fuel side and the cylindrical portion 27*c* on the transpiration gas side that are integrated, and higher component precision is thus required. However, in the case of the integrated component, it is not necessary to keep the fuel inlet port 15 and the transpiration gas inlet port 27 in an intended positional relationship when the component is sandwiched by the left-side and right-side delivery pipes 4L and 4R, and it is thus possible to obtain another advantage that the assembly operation can be more easily performed.

Figure 14:
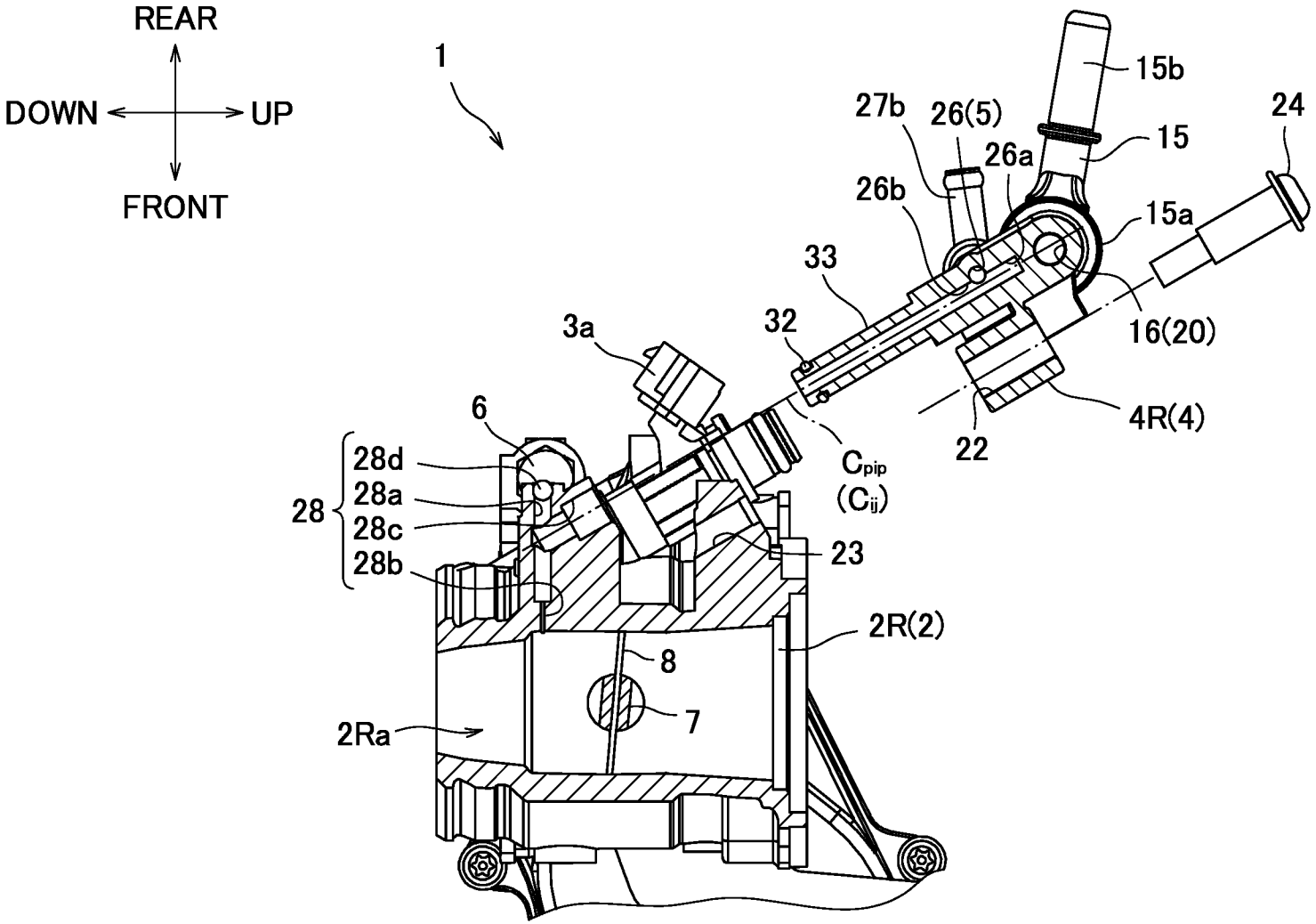
FIG. 14 is an exploded view illustrating another example in which the connection pipe is configured as a component integrated with the delivery pipe and corresponding to FIG. 12.

Although the connection pipe 33 is a component separate from the left-side and right-side delivery pipes 4L and 4R in the aforementioned embodiment, the connection pipe 33 and the left-side and right-side delivery pipes 4L and 4R may be an integrated component as illustrated in FIG. 14. In this case, the distal end of each connection pipe 33 corresponds to the substantial delivery pipe-side connection port according to the present invention. Since the inter-axis distance of each connection pipe 33 is fixed via the delivery pipe 4 similarly to the aforementioned case in which the fuel inlet port 15 and the transpiration gas inlet port 27 are integrated, higher component precision is required to cause the inter-axis distance to conform to the inter-axis distance of each transpiration gas receiving port 28*c* on the side of the throttle body 2.

Figure 15:
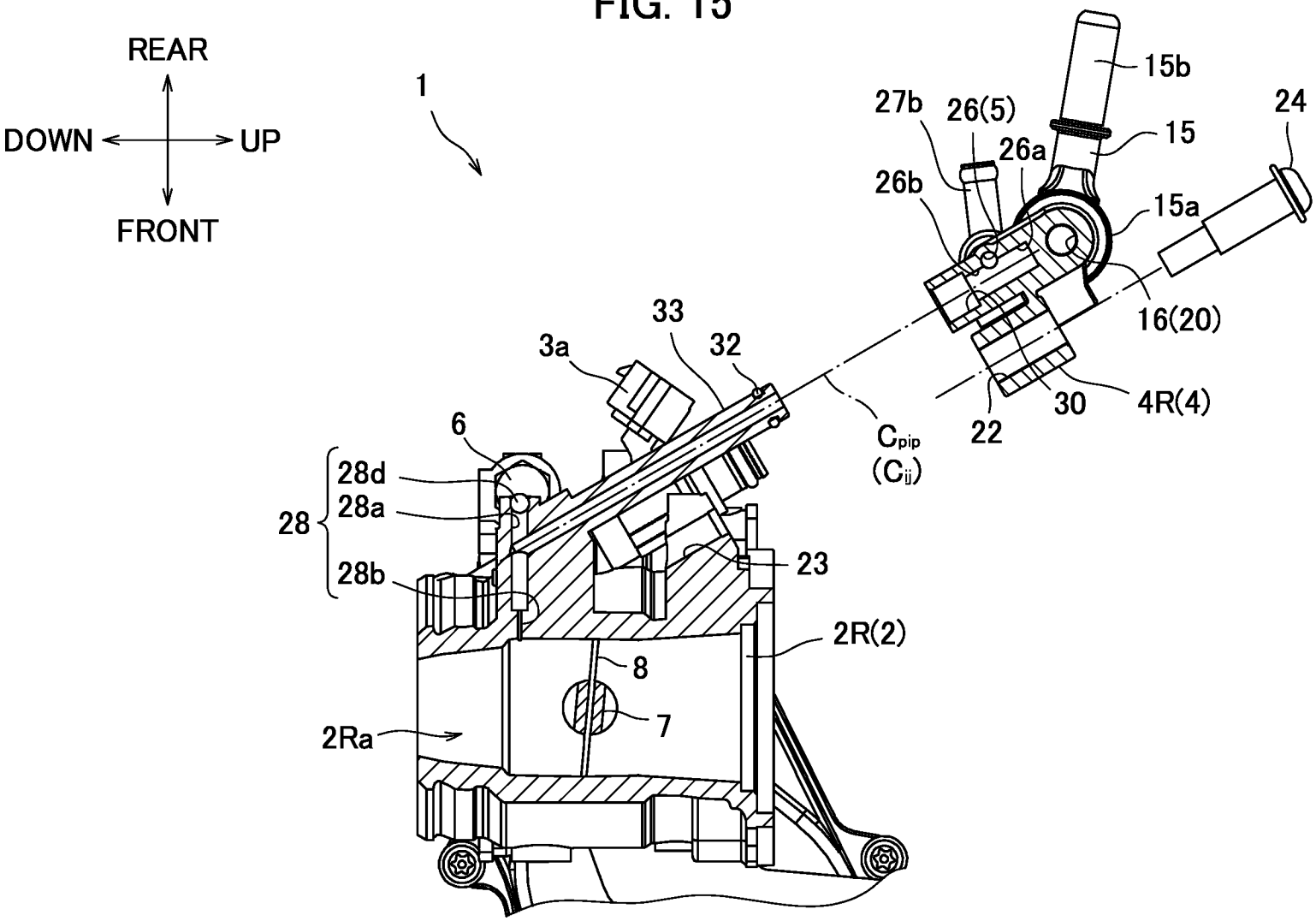
FIG. 15 is an exploded view illustrating another example in which the connection pipe is configured as a component integrated with the throttle body and corresponding to FIG. 12.

However, it is not necessary to perform the operation of inserting the one end of the connection pipe 33 to each of the downstream insertion holes 30 of the left-side and right-side delivery pipes 4L and 4R, and it is thus possible to obtain another advantage that the assembly operation can be more easily performed. In addition, since leakage does not occur at the location where the connection pipe 33 is inserted into each downstream insertion hole 30, it is possible to further improve reliability. Note that each connection pipe 33 may be provided as a component integrated with the throttle body 2 in a manner opposite to the above description as illustrated in FIG. 15. Although the description will not be repeated, effects and advantages that are similar to those described above are obtained.

REFERENCE SIGNS LIST

1 Intake device
2 Throttle body
2La, 2Ra Bore
3 Injector
4 Delivery pipe
4L Left-side delivery pipe (first delivery pipe)
4R Right-side delivery pipe (second delivery pipe)
5 Transpiration gas passage, intake air pressure collecting passage (intake pipe communication passage)
8 Throttle valve
15 Fuel inlet port
15*b*, 27*b* Nipple portion (connection portion)
15*c*, 27*c* Cylindrical portion
18 Downstream insertion hole (fuel outlet port)
19, 31, 32 O ring
20 Fuel passage
25 Transpiration gas hose
27 Transpiration gas inlet port, sensor connection port (collecting connection port)
28*c* Transpiration gas receiving port, intake air pressure extraction port (throttle body-side connection port)
30 Downstream insertion hole (delivery pipe-side connection port)
41 Pressure sensor

What is claimed is:

1. An intake device for a multiple-cylinder engine comprising:

a throttle body including a plurality of bores, each of which communicates with an inside of each cylinder of the engine, and provided with throttle valves for adjusting intake volumes inside the bores in an openable and closable manner;

injectors provided in the throttle body and injecting a fuel to each bore;

a delivery pipe for supplying the fuel to the injectors; and an intake pipe communication passage connected to the inside of each bore and communicating with the inside of each bore, wherein the intake pipe communication passage is formed integrally with the delivery pipe.

2. The intake device for a multiple-cylinder engine according to claim 1, wherein the delivery pipe is provided with a fuel inlet port connected to a fuel tank side and fuel outlet ports connected to the injectors in the throttle body, a fuel passage branched from the fuel inlet port and extending to each fuel outlet port being formed inside the delivery pipe, and the intake pipe communication passage is formed therein to be parallel to an alignment direction of each cylinder with the fuel passage.

3. The intake device for a multiple-cylinder engine according to claim 2, wherein the delivery pipe is provided with a collecting connection port for connection to the intake pipe communication passage and is provided with a delivery pipe-side connection port for connection to an inside of each bore.

4. The intake device for a multiple-cylinder engine according to claim 3, wherein the throttle body includes each throttle body-side connection port for connection to the delivery pipe-side connection port, the throttle body-side connection port is a transpiration gas receiving port for supplying, to the inside of each bore, transpiration gas adsorbed by a canister of a transpiration gas treatment device, the collecting connection port of the delivery pipe is a transpiration gas inlet port to which the canister of the transpiration gas treatment device is connected, and the intake pipe communication passage of the delivery pipe is a transpiration gas passage branching the transpiration gas from the canister flowing in from the transpiration gas inlet port and guiding the transpiration gas to each transpiration gas receiving port of the throttle body through each delivery pipe-side connection port.

5. The intake device for a multiple-cylinder engine according to claim 3, wherein the throttle body includes each throttle body-side connection port for connection to the delivery pipe-side connection port, and the throttle body-side connection port is an intake air pressure extraction port for extracting an intake air pressure generated inside each bore, the collecting connection port of the delivery pipe is a sensor connection port to which a pressure sensor detecting the intake air pressure is connected, and the intake pipe communication passage of the delivery pipe is an intake air pressure collecting passage merging intake air pressures generated in each bore of the throttle body and guided from the intake air pressure extraction port to the delivery pipe-side connection port and guiding the merged intake air pressures to the collecting connection port.

6. The intake device for a multiple-cylinder engine according to claim 3, wherein each of the fuel passage and the intake pipe communication passage is opened from one end surface of the delivery pipe toward one side, and the fuel inlet port and the collecting connection port are produced as components separated from the delivery pipe and are connected to opening locations of the fuel passage and the intake pipe communication passage from the other side.

7. The intake device for a multiple-cylinder engine according to claim 6, wherein the fuel inlet port and the collecting connection port are produced as a mutually integrated component.

8. The intake device for a multiple-cylinder engine according to claim 3, wherein the delivery pipe is split into a first delivery pipe and a second delivery pipe, the first delivery pipe and the second delivery pipe have the fuel passages opened to face each other and have the intake pipe communication passages opened to face each other, and the fuel inlet port and the collecting connection port are produced as components separated from the first delivery pipe and the second delivery pipe, each of the fuel inlet port and the collecting connection port being sandwiched between the first delivery pipe and the second delivery pipe and being connected to opening locations of the fuel passages and the intake pipe communication passages from both sides.

9. The intake device for a multiple-cylinder engine according to claim 8, wherein the fuel inlet port and the collecting connection port are produced as components separated from each other and have angles which are changeable around axial lines of cylindrical portions formed on both sides of the fuel inlet port and the collecting connection port.

10. The intake device for a multiple-cylinder engine according to claim 8, wherein the fuel inlet port and the collecting connection port are produced as a mutually integrated component.

11. The intake device for a multiple-cylinder engine according to claim 3, wherein each delivery pipe-side connection port of the delivery pipe is connected to each throttle-side connection port of the throttle body via a connection pipe produced as a separated component.

12. A fuel delivery pipe used for an engine including a throttle body having a plurality of bores, each of which communicates with an inside of each cylinder of the engine, and is provided with throttle valves for adjusting intake volumes inside the bores in an openable and closable manner and injectors provided in the throttle body and injecting a fuel to each bore, the fuel delivery pipe comprising:

a fuel inlet port connected to a fuel tank side;

fuel outlet ports connected to the injectors of the throttle body;

a fuel passage formed in the fuel delivery pipe, branched from the fuel inlet port, and extending to the fuel outlet ports;

an intake pipe communication passage supplying transpiration gas to each bore;

a collecting connection port for introducing the transpiration gas into the intake pipe communication passage; and a delivery pipe-side connection port for supplying the transpiration gas to the inside of each bore, wherein both the fuel passage and the intake pipe communication passage extend to be parallel to an alignment direction of each cylinder and are integrally formed.

13. A fuel delivery pipe used for an engine including a throttle body having a plurality of bores, each of which communicates with an inside of each cylinder of the engine, and is provided with throttle valves for adjusting intake volumes inside the bores in an openable and closable manner and injectors provided in the throttle body and injecting a fuel to each bore, the fuel delivery pipe comprising:

a fuel inlet port connected to a fuel tank side;

fuel outlet ports connected to the injectors of the throttle body;

a fuel passage formed inside the fuel delivery pipe, branched from the fuel inlet port, and extending to the fuel outlet ports;

an intake pipe communication passage for introducing an intake air pressure of each bore;

a collecting connection port for connection to a pressure sensor for measuring a pressure in the intake pipe communication passage; and a delivery pipe-side connection port for connection to the inside of each bore, wherein both the fuel passage and the intake pipe communication passage extend to be parallel to an alignment direction of each cylinder and are integrally formed.

* * * * *